US011479431B2

(12) United States Patent
Trampolski

(10) Patent No.: US 11,479,431 B2
(45) Date of Patent: Oct. 25, 2022

(54) DISPENSING SYSTEMS WITH FLOATING SUPPORT ROLLERS

(71) Applicant: Dispensing Dynamics International, Inc., City of Industry, CA (US)

(72) Inventor: Alexander Trampolski, City of Industry, CA (US)

(73) Assignee: Dispensing Dynamics International, Inc., San Marcos, CA (US)

( * ) Notice: Subject to any disclaimer, the term of this patent is extended or adjusted under 35 U.S.C. 154(b) by 90 days.

(21) Appl. No.: 16/931,308

(22) Filed: Jul. 16, 2020

(65) Prior Publication Data

US 2021/0016987 A1 Jan. 21, 2021

Related U.S. Application Data

(60) Provisional application No. 62/876,456, filed on Jul. 19, 2019.

(51) Int. Cl.

| | |
|---|---|
| ***B65H 23/26*** | (2006.01) |
| ***A47K 10/38*** | (2006.01) |
| ***B65H 20/02*** | (2006.01) |

(52) U.S. Cl.

CPC ..... *B65H 23/26* (2013.01); *A47K 10/38* (2013.01); *B65H 20/02* (2013.01); *B65H 2301/41501* (2013.01); *B65H 2701/1924* (2013.01)

(58) Field of Classification Search

None

See application file for complete search history.

(56) References Cited

U.S. PATENT DOCUMENTS

| | | | |
|---|---|---|---|
| 1,543,299 | A | 6/1925 | Shelley |
| 2,051,242 | A | 8/1936 | Birr et al. |
| 2,560,061 | A | 7/1951 | Agamaite, Jr. |
| 2,830,810 | A | 4/1958 | Colburn et al. |
| 3,575,328 | A | 4/1971 | Jespersen |

(Continued)

FOREIGN PATENT DOCUMENTS

| | | |
|---|---|---|
| EP | 1877230 B1 | 10/2016 |
| WO | WO 92/14590 A1 | 9/1992 |

(Continued)

OTHER PUBLICATIONS

"The International Dispensing System" Catalog, Dispensing Dynamics International, 2010, pp. 1-60.

(Continued)

*Primary Examiner* — William A. Rivera

(74) *Attorney, Agent, or Firm* — Knobbe, Martens, Olson & Bear, LLP

(57) ABSTRACT

Various dispensing systems with floating support rollers are disclosed. In certain embodiments, the dispensing system can include a housing, roll support arm, and a dispensing mechanism that can enable dispensing of tissue from a roll mounted on the roll supporting arm. The dispensing mechanism can include a main roller and a support roller. The support roller can move from a first position to a second position in response to a user pulling on a tail end of the tissue. The support roller can be biased towards the first position and can apply a compressive force to the main roller in the second position. The compressive force can urge the tissue towards the main roller and can provide improved tissue support.

19 Claims, 18 Drawing Sheets

(56) References Cited

U.S. PATENT DOCUMENTS

| | | | | |
|---|---|---|---|---|
| 3,739,965 | A | 6/1973 | Jespersen et al. | |
| 3,896,691 | A | 7/1975 | Granger et al. | |
| 3,918,661 | A | 11/1975 | Kishi et al. | |
| RE28,911 | E | 7/1976 | Jespersen et al. | |
| 3,998,120 | A | 12/1976 | Granger et al. | |
| 4,122,738 | A | 10/1978 | Granger | |
| 4,186,633 | A | 2/1980 | Baumann et al. | |
| 4,188,844 | A | 2/1980 | DeLuca | |
| 4,213,363 | A | 7/1980 | Granger | |
| 4,276,797 | A | 7/1981 | Baumann et al. | |
| 4,307,639 | A | 12/1981 | DeLuca | |
| 4,404,880 | A | 9/1983 | DeLuca | |
| 4,432,261 | A | 2/1984 | DeLuca | |
| 4,441,392 | A | 4/1984 | DeLuca | |
| 4,621,755 | A | 11/1986 | Granger | |
| 4,635,837 | A | 1/1987 | Granger | |
| 4,712,461 | A | 12/1987 | Rasmussen | |
| 4,807,824 | A | 2/1989 | Gains et al. | |
| 4,844,361 | A | 7/1989 | Granger | |
| 4,846,035 | A | 9/1989 | Granger | |
| 5,013,291 | A | 5/1991 | Granger | |
| 5,048,386 | A | 9/1991 | DeLuca et al. | |
| 5,078,033 | A | 1/1992 | Formon | |
| 5,108,357 | A | 8/1992 | Granger | |
| 5,135,147 | A | 8/1992 | Granger | |
| 5,146,830 | A | 9/1992 | Granger | |
| 5,207,633 | A | 5/1993 | Granger | |
| 5,269,397 | A | 12/1993 | Kawamoto et al. | |
| 5,441,189 | A | 8/1995 | Formon et al. | |
| 5,868,343 | A | 2/1999 | Granger | |
| 5,938,142 | A | 8/1999 | Halperin | |
| 5,988,561 | A | 11/1999 | Mele | |
| 6,237,871 | B1 | 5/2001 | Morand et al. | |
| 6,314,850 | B1 | 11/2001 | Morand | |
| 6,354,533 | B1 * | 3/2002 | Jespersen | A47K 10/36 242/560.1 |
| 6,363,824 | B1 | 4/2002 | Granger | |
| 6,439,501 | B1 | 8/2002 | Harmathy | |
| 6,460,798 | B1 | 10/2002 | Haen et al. | |
| 6,474,591 | B1 | 11/2002 | Granger | |
| 6,497,167 | B1 | 12/2002 | Granger | |
| 6,553,879 | B2 | 4/2003 | Morand | |
| 6,607,160 | B2 * | 8/2003 | Lewis | A47K 10/3687 242/564.4 |
| 6,622,953 | B2 | 9/2003 | Inana et al. | |
| 6,736,348 | B1 * | 5/2004 | Formon | A47K 10/3687 242/559.4 |
| 6,871,815 | B2 | 3/2005 | Moody et al. | |
| 7,270,292 | B2 * | 9/2007 | Rasmussen | A47K 10/3687 242/560.1 |
| 7,500,420 | B2 | 3/2009 | Cvjetkovic et al. | |
| 8,082,827 | B2 | 12/2011 | Friesen et al. | |
| 8,146,471 | B2 | 4/2012 | Hansen et al. | |
| 8,162,252 | B2 | 4/2012 | Cittadino et al. | |
| 8,220,684 | B1 | 7/2012 | Keily et al. | |
| 8,424,431 | B1 | 4/2013 | Jackman et al. | |
| 8,444,080 | B2 | 5/2013 | Hagleitner | |
| 8,733,218 | B2 * | 5/2014 | Hansen | A47K 10/3643 83/335 |
| 9,795,258 | B2 | 10/2017 | Keily et al. | |
| 9,854,948 | B1 | 1/2018 | Paal et al. | |
| 9,895,033 | B2 | 2/2018 | Keily et al. | |
| 10,271,695 | B2 | 4/2019 | Keily et al. | |
| 10,292,542 | B2 | 5/2019 | Morand | |
| 11,241,124 | B2 | 2/2022 | Keily et al. | |
| 2002/0117034 | A1 | 8/2002 | Granger | |
| 2003/0025030 | A1 | 2/2003 | Granger et al. | |
| 2007/0278334 | A1 | 12/2007 | Granger et al. | |
| 2009/0039099 | A1 | 2/2009 | Friesen | |
| 2009/0057478 | A1 * | 3/2009 | Conner | A47K 10/36 242/564 |
| 2009/0314875 | A1 * | 12/2009 | Granger | A47K 10/3643 242/560 |
| 2010/0051399 | A1 | 3/2010 | Weber et al. | |
| 2011/0101151 | A1 | 5/2011 | Hagleitner | |
| 2013/0043266 | A1 | 2/2013 | Hagleitner | |
| 2014/0116216 | A1 | 5/2014 | Morand | |
| 2015/0082960 | A1 | 3/2015 | Niada | |
| 2015/0374181 | A1 | 12/2015 | Morand | |
| 2016/0242603 | A1 | 8/2016 | Cvjetkovic | |
| 2018/0170703 | A1 | 6/2018 | Osborne, Jr. | |
| 2018/0325331 | A1 | 11/2018 | Gottschalk | |

FOREIGN PATENT DOCUMENTS

| | | | |
|---|---|---|---|
| WO | WO 2006/115952 | A2 | 11/2006 |
| WO | WO 2016/032627 | A1 | 3/2016 |
| WO | WO 2016/089508 | A1 | 6/2016 |
| WO | WO 2016/089589 | A1 | 6/2016 |
| WO | WO 2018/071126 | A1 | 4/2018 |

OTHER PUBLICATIONS

International Search Report and Written Opinion, re PCT Application No. PCT/US2020/042395 dated Sep. 8, 2020.

International Preliminary Report on Patentability for PCT Application No. PCT/US2020/042395, dated Feb. 3, 2022.

* cited by examiner

DISPENSING SYSTEMS WITH FLOATING SUPPORT ROLLERS

CROSS REFERENCE

This application claims the priority benefit of U.S. Provisional Patent Application No. 62/876,456, filed Jul. 19, 2019, the entirety of which is incorporated by reference herein.

BACKGROUND

Field

This disclosure generally relates to an apparatus for dispensing consumable material, such rolls of paper towels.

Description of Certain Related Art

Tissue dispensers provide a convenient storage system for rolls of consumable material. The rolls of consumable material can be referred to as "tissue rolls," for example, rolls of fibrous paper products or tissue paper (e.g., bathroom tissue, paper towels, or other). Tissue dispensers are generally designed to hold one or multiple rolls of tissue paper and to provide a dispensing mechanism. The dispensing mechanism generally allows a user to retrieve a length of the roll. As one length of the tissue paper is dispensed, an additional length becomes available. This process slowly depletes the roll.

SUMMARY OF CERTAIN ASPECTS

It can be desirable to provide a dispensing mechanism with increased tissue control. Increased tissue control may prevent the tissue from being stuck inside the dispensing mechanism and/or prevent ripping, crumpling, and/or irregular dispensing (e.g., dispensing in inconsistent lengths) of the tissue. Less advantageous dispensing mechanisms may not sufficiently maintain tissue control and may allow the tissue to, for example, move away from a main roller, which can cause (1) tearing, (2) crumpling, and/or (3) irregular incisions made to the tissue during dispensing. In addition, when the tissue is torn or crumpled, it can sometimes be stuck within the dispensing mechanism (for example, between the main roller and the guide wall).

It can be advantageous to maintain tissue control during dispensing by approximating the tissue towards the outer circumferential surface of the main roller of the dispensing mechanism. When the tissue is sufficiently approximated towards the outer circumferential surface of the main roller, incisions can be made at more consistent basis, which can result in tissues with consistent lengths dispensed. Moreover, approximating the tissue towards the outer circumferential surface of the main roller can prevent the tissue from bending away (e.g., moving away) from the main roller and crumpling, thereby reducing the likelihood of the tissue getting stuck (for example, between the main roller and the guide wall) within the dispensing mechanism and/or irregular incisions being made to the tissue. The technology of this disclosure addresses one or more of the aforementioned concerns or aims, or others.

In certain embodiments, a dispensing system includes a housing, a roll support arm, and a dispensing mechanism. The roll support arm and the dispensing mechanism can be in the housing. The dispensing mechanism can enable dispensing of tissue from a roller mounted on the roll support arm. The dispensing mechanism can include a main roller and a support roller. The support roller can move from a first position to a second position in response to a user pulling on a tail end of the tissue. The support roller can be biased towards the first position and/or can apply a compressive force to the main roller when in the second position.

In some implementations, the dispensing system can include a support frame (for example, a cover) with an elongated slot that can receive the support roller. The elongated slot includes a first portion at one end and a second portion at an opposite end. The support roller can move along the elongated slot in a circumferential direction relative to the main roller. The support roller can be in the first portion of the elongated slot when the support roller is in the first position. The support roller can be in the second portion of the elongated slot when the support roller is in the second position. The support roller can slide in the slot.

In some implementations, the slot of the support frame can be dimensioned such that the support roller may be biased towards the first portion of the slot. The support roller may be biased towards the first position by force of gravity. Additionally or alternatively, the slot of the support frame can be dimensioned such that the compressive force increases when the roller moves from the first portion to the second portion, and the compressive force decreases when the support roller moves from the second portion to the first portion.

The first position of the support roller can be associated with a resting position of the support roller, and the second position of the support roller can be associated with an actuated position of the support roller.

In some implementations, the dispensing mechanism can include a main guide and a guide extension. The guide extension can be a separate component from the main guide and can be positioned circumferentially between the support roller and the main guide. The guide extension can be fixedly attached (directly or indirectly) to the main guide.

In some implementations, tension in the tissue may increase when the tissue is pulled from the dispensing system. The increase in the tension in the tissue can cause the support roller to move from the first position to the second position against the force of gravity. When at least a portion of the tissue is dispensed from the dispensing system, tension in the tissue can decrease. The decrease in the tension in the tissue can cause the support roller to automatically move from the second position to the first position by force of gravity.

The main roller can rotate in a first direction in response to the tissue pulled from the dispensing system. The main roller can rotate in a second direction after at least a portion of the tissue is dispensed. In some implementations, the dispensing system can include a rotation system that can facilitate rotation of the main roller after at least a portion of the tissue is dispensed from the dispensing system. The rotation system can include a clip and biasing members. The clip can be fixedly coupled to the axle of the main roller and the biasing members can be fixedly coupled to the clip. The biasing members can generate restoring force to the main roller via the clip, where the restoring force can cause the main roller to rotate back to its resting position.

In some implementations, the main roller can include a first external surface and the support roller can include a second external surface. The first external surface and the second external surface can include elastomeric portions.

In certain embodiments, a dispensing mechanism can include a main roller, a support roller, a main guide, and a secondary guide. The support roller can have a first configuration and a second configuration, where the support roller can move from the first configuration and the second configuration in response to the tissue being pulled from the dispensing system. The main guide can extend in an axial direction relative to the main roller and include a first guide wall. The first guide wall can extend in a circumferential direction relative to an outer circumferential surface of the main roller. The secondary guide can extend in the axial direction relative to the main roller and can be positioned circumferentially between the support roller and the main guide. The secondary guide can include a second guide wall that can extend in the circumferential direction relative to the outer circumferential surface of the main roller. The secondary guide can be fixed relative to the main guide. The main guide and the secondary guide can cooperate to guide the tissue around more than 180 degrees of the outer circumferential surface of the main roller.

In certain embodiments, a method of manufacturing a dispensing system can include obtaining a support frame, a main roller, a support roller having a radial center, a guide, and a guide extension. The method can further include positioning the support roller circumferentially between the support roller and the guide. The method can further include positioning the support roller in an elongated slot of the support frame. The support roller can slide in the slot between a first configuration and a second configuration. The radial center of the support roller can be closer to the outer circumferential surface of the main roller in the second configuration than in the first configuration.

In some implementations, the guide and the guide extension can be formed separately. The method can further include fixedly connecting the guide extension and the guide. The guide can include a first guide wall and the guide extension can include a second guide wall. The first guide wall and the second guide wall can include curvatures that correspond to a curve of an outer circumferential surface of the main roller.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

Certain features of this disclosure are described below with reference to the drawings. The illustrated embodiments are intended to illustrate, but not to limit the embodiments. Various features of the different disclosed embodiments can be combined to form further embodiments, which are part of this disclosure.

DETAILED DESCRIPTION OF CERTAIN EMBODIMENTS

Various dispensing systems and methods are described. Certain embodiments of the dispensing systems are described in the context of a roll of paper towels, due to particular utility in that context. However, the embodiments and inventions disclosed herein can also be applied to rolls of other types of consumable materials, such as tissue paper, bathroom tissue, facial tissue, napkins, cleaning (e.g., sanitizing) wipes, or otherwise. No features, structure, or step disclosed herein is essential or indispensable.

Overview

Figure 1B:
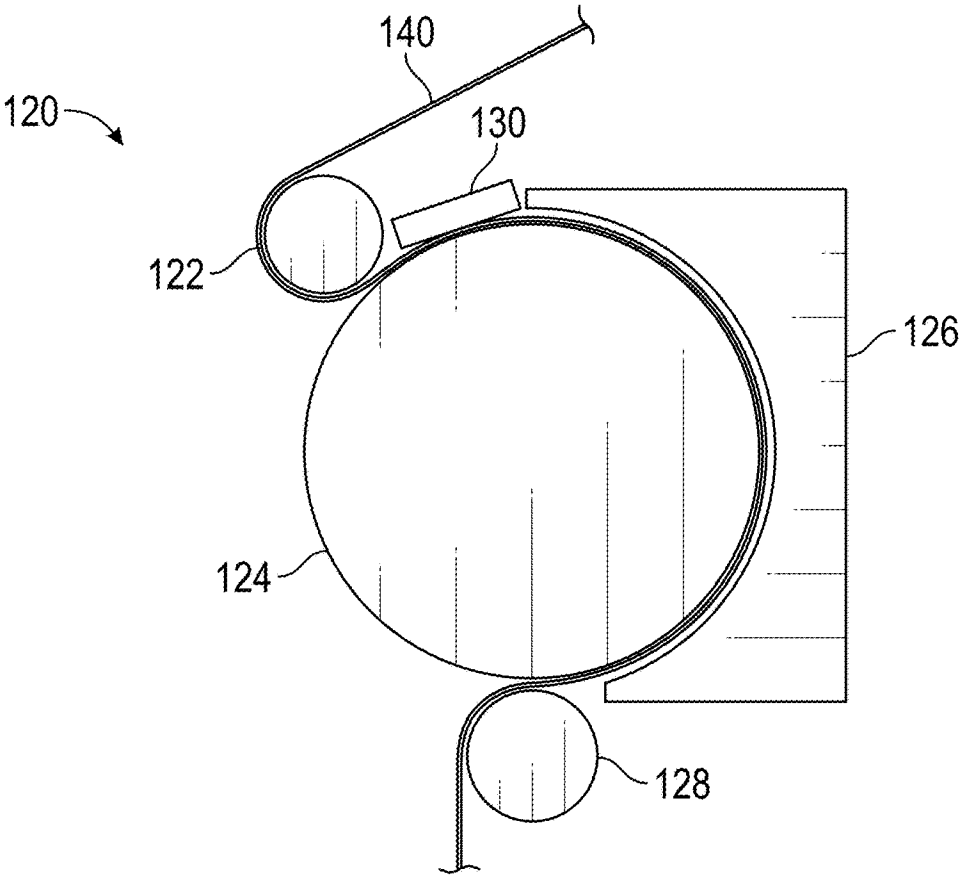
FIG. 1B schematically illustrates a dispensing mechanism of the dispensing system.
Figure 1A:
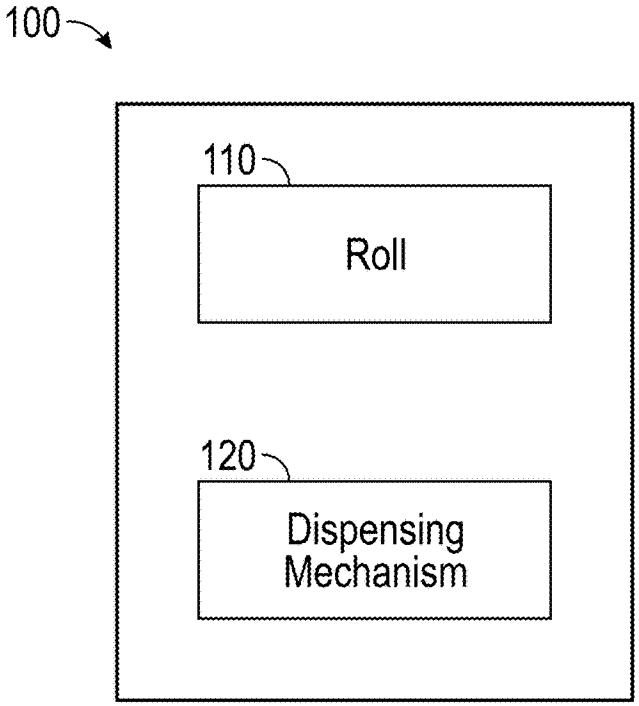
FIG. 1A schematically illustrates a dispensing system.

FIG. 1A schematically illustrates a dispensing system 100. The dispensing system 100 can include a paper towel dispenser, toilet paper dispenser, facial tissue dispenser, rolled napkin dispenser, wipes dispenser, or other type of dispenser. The dispensing system 100 can dispense product that is wound on a core, such as a roll 110 of tissue, via the dispensing mechanism 120.

FIG. 1B schematically illustrates the dispensing mechanism 120. For example, tissue 140 from the roll 110 can be fed into the dispensing mechanism 120, which can facilitate dispensing of the tissue 140 from the dispensing system 100. The dispensing mechanism 120 can include one or more of a support roller 122, a main roller 124, a guide 126 (also called a main guide or a primary guide), a dispense roller 128, and a guide extension 130 (also called a secondary guide). The support roller 122 may also be referred to as pinch roller. As illustrated, in various embodiments, the tissue 140 wrap around the main roller 124 starts and ends between the support and dispense rollers 122, 128.

The support roller 122 can receive the tissue 140 and direct the tissue 140 toward the main roller 124. In the example illustration shown in FIG. 1B, the support roller 122 can rotate in a first direction to direct the paper issue 140 towards the main roller 124. The first direction may be clockwise direction (CW) or counter clockwise (CCW) direction. As further described herein, the support roller 122 can include an axle that allows the support roller 122 to rotate about an axis. The axis of rotation of the support roller 122 may be defined, for example, by the axial length of the support roller 122 or the axles of the support roller 122.

The support roller 122 may be positioned at a predetermined distance from the main roller 124 such that an outer circumferential surface of the support roller 122 is spaced apart from and/or may be not be in contact with an outer circumferential surface of the main roller 124. This configuration may advantageously facilitate feeding of the tissue 140 between the support roller 122 and the main roller 124. Alternatively, in some embodiments, the outer circumferential surface of the support roller 122 may be in contact with the outer circumferential surface of the main roller 124. This configuration can advantageously allow approximation of the tissue 140 against the outer circumferential surface of the main roller 124, provide a bias on the support roller, and/or otherwise.

The guide 126 and the guide extension 130 can together facilitate movement of the tissue 140 along a portion of the outer circumferential surface of the main roller 124. In the example illustration shown in FIG. 1B, the guide 126 and the guide extension 130 can be positioned between (e.g., circumferentially and/or in the direction of paper travel) the support roller 122 and the dispense roller 128. In some embodiments, the guide 126 and the guide extension 130 can facilitate or ensure that the tissue 140 remains approximate to (e.g., in contact with) the outer circumferential surface of the main roller 124 between the support roller 122 and the dispense roller 128.

The dispense roller 128 can facilitate dispensing of the tissue 140. The dispense roller 128 can rotate about its axis of rotation when, for example, the tissue 140 is being pulled from the dispense system 100. The dispense roller 128 can be at or near an outlet of the dispenser system 100. In some embodiments, the dispense roller 128 can have ends (e.g., axle ends) housing in an elongated slot. As shown, the support roller 122 can be higher than the dispense roller 128 and/or can be closer to the roll of tissue than the dispense roller 128. The dispense roller 128 can have any of the features of the support roller 122, such as the slot, floating functionality, gravity bias, etc.

Figure 2:
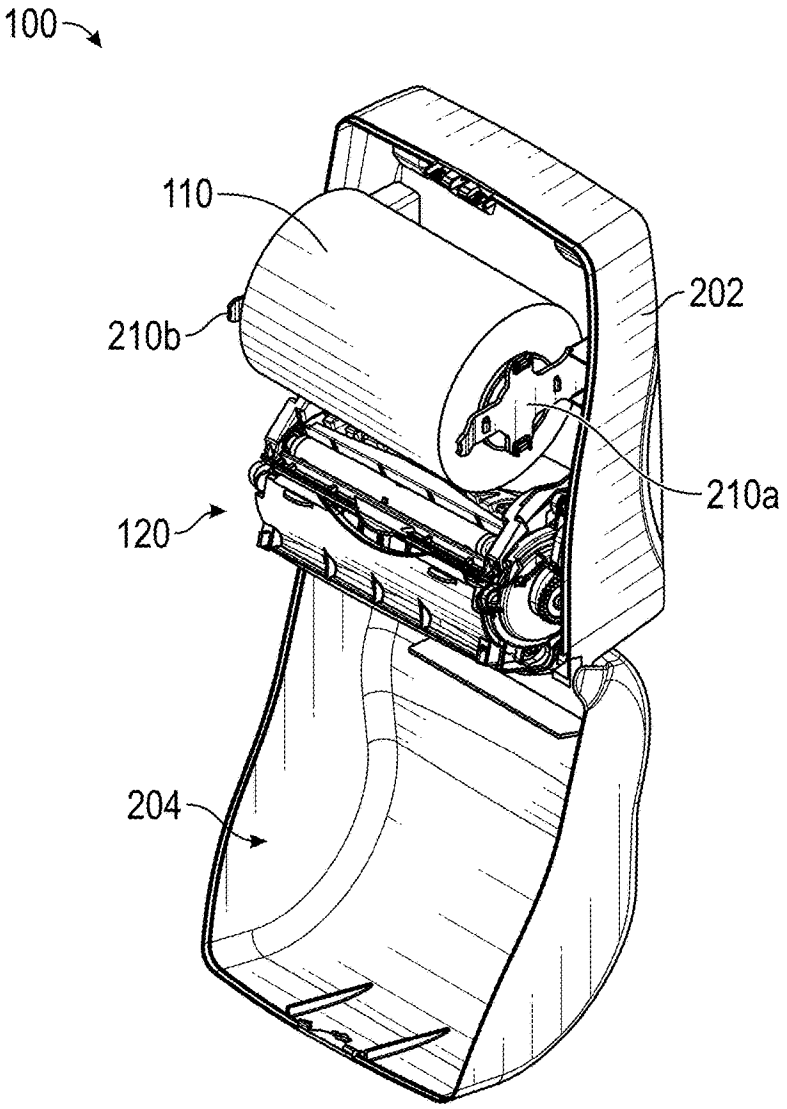
FIG. 2 illustrates the dispensing system with a cover in an open position.

FIG. 2 illustrates the dispensing system 100 with an outer housing in an open position. The outer housing can be made of plastic, metal, or any suitable material (for example, ABS polyethylene, polypropylene, and/or other polymers). The housing can include a front 204 and a rear 202. The front 204 can be hingedly coupled to the rear 202. When the front 204 is in a closed position, the front 204 and the rear 202 can enclose the roll 110 and the dispensing mechanism 120. The rear 202 can include a plurality holes and/or connector mechanisms for engaging with a wall or other structure for mounting the dispenser system 100 (e.g., in a bathroom or other location). The front 204 can be hingedly attached with the rear 202, for example, at a hinge of the housing. The housing can include a locking mechanism that secures the front 204 and rear 202, thereby limiting access to an inside of the housing. The locking mechanism can require a key or other specialized tool to open the housing. The housing can include a viewing area, such as a clear window, on the front, top, or sides. The viewing window can enable a user to see the status of the roll 110, such as whether the roll 110 is in a main dispensing position, thereby revealing whether the dispensing system 100 is due to receive a fresh (e.g., full) roll.

The dispensing system 100 can include a roll support 210*a*. The roll support 210*a* can at least partially support the roll 110, such as an axial side of the roll 110. In some embodiments, the dispensing system 100 includes a second roll support 210*b*, which can support an opposite axial side of the roll 110. The dispenser system 100 can include any of the features, such as those related to roll supports, disclosed in U.S. patent application Ser. No. 16/844,924, filed Apr. 9, 2020, which is incorporated by reference herein in its entirety, but shall not be used for construing the claims herein.

Figure 3A:
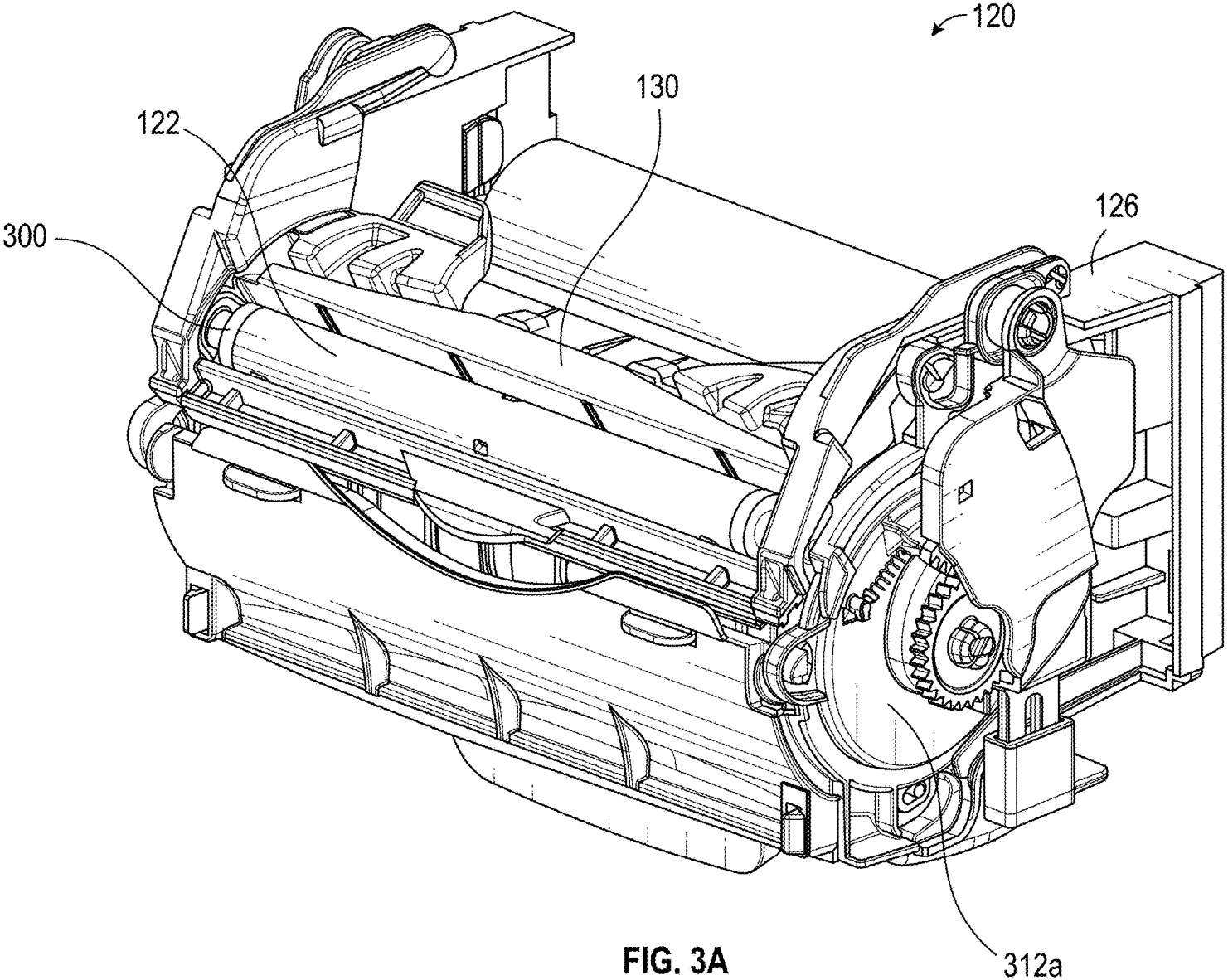
FIG. 3A illustrates a perspective view of the dispensing mechanism.
Figure 3B:
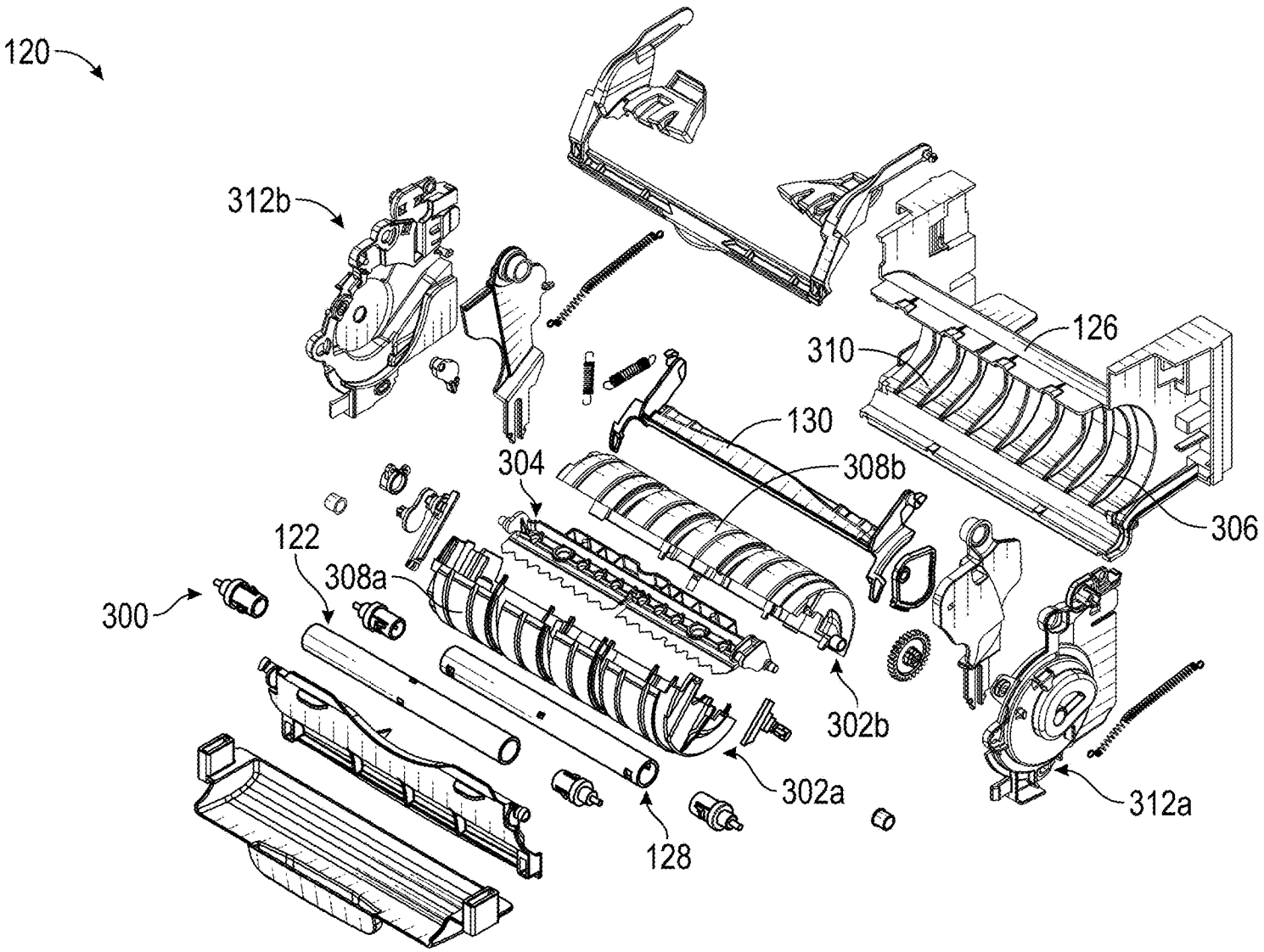
FIG. 3B illustrates an exploded view of the dispensing mechanism.

FIGS. 3A and 3B illustrate various views of the dispensing mechanism 120. The dispensing mechanism 120 can include the support roller 122, the main roller 124, the guide 126, the dispense roller 128, and the guide extension 130. Certain embodiments include caps 300, casings 302*a*, 302*b*, an incision mechanism 304, and/or covers 312*a*, 312*b* (also called support frames).

The guide 126, as shown in FIGS. 1B and 3B, can include a guide wall 306. The guide wall 306 can be concave and/or an inverted arcuate surface that can extend in a circumferential direction relative to the outer circumferential surface of the main roller 124. The shape of the guide wall 306 may or may not correspond to the outer circumferential surface of the main roller 124. For example, the guide wall 306 can be generally circular such that the contour of the guide wall 306 can correspond to that of the outer circumferential surface of the main roller 124. In some variants, the contour of the guide wall 306 may be different from that of the outer circumferential surface of the main roller 124. The guide 126 can be dimensioned such that the guide wall 306 can surround at least a portion of the outer circumferential surface of the main roller 124 (e.g., at least about 120 degrees and/or less than or equal to about 210 degrees). In some embodiments, the guide wall 306 can extend around about a half of the outer circumferential surface of the main roller 124. In some embodiments, the guide wall 306 can extend between about a quarter and about a half of the outer circumferential surface of the main roller 124.

The guide wall 306 of the guide 126 can be positioned at a predetermined distance from the main roller 124. In some embodiments, the distance between the guide wall 306 and the main roller 124 may vary along the outer circumferential surface of the main roller 124. For example, the distance between the guide wall 306 and the main roller 124 may increase or decrease from about the top portion of the main roller 124 (for example, a portion proximate to the guide extension 130) to about the bottom portion of the main roller 124 (for example, a portion proximate to the dispense roller 128). The distance between the guide wall 306 and the outer circumferential surface of the main roller 124 may be sufficient to allow the tissue 140 to pass between the guide wall 306 and the main roller 124.

The guide 126 can include one or more fins 310 that can guide the tissue 140 along an outer circumference of the main roller 124. The fins 310 can radially extend away from the guide wall 306. The fins 310 can extend in a circumferential direction along the guide wall 306. The fins 310 can extend in a circumferential direction along at least a portion (e.g., majority of the circumferential length) of the guide wall 306. The guide extension 130 can have similar fins as the fins 130 on the guide 126.

In some embodiments, the ends of the fins 310 may be positioned at a certain distance from the main roller 124.

This can advantageously allow the ends of the fins 310 to guide the tissue 140 along the outer circumference of the main roller 124 as the tissue 140 travels between the outer circumference of the main roller 124 and the guide 126. For example, even if the contour of the guide wall 306 does not correspond to the outer circumference of the main roller 124, the fins 310 can extend from the guide wall 306 at a varying length along circumference of the guide wall 306 such that the ends of the fins 310 may be positioned at a certain distance from the outer circumferential surface of the main roller 124.

In some embodiments, the fins 310 can extend in a circumferential direction along the guide wall 306 in a direction substantially orthogonal to the length of the guide wall 306 (or the length of the main roller 124). In other embodiments, the fins 306 can extend in a circumferential direction along the guide wall 306 at an angle with respect to the length of the guide wall 306 (or the length of the main roller 124).

In some embodiments, the fins 310 (or the guide wall 306) can be made of materials that have low coefficient of friction with respect to the tissue 140 to reduce the amount of friction between the fins 310 (or the guide wall 306) and the tissue 140. This can advantageously facilitate the movement of the tissue 140 through the dispensing mechanism 120 between the main roller 124 and the guide 126.

As mentioned above, the mechanism 120 can include the support roller 122. In some embodiments, the support roller 122 includes the caps 300. For example, the caps 300 can be coupled to each end of a body of the support roller 122. The caps 300 can allow the support roller 122 to rotate about an axis substantially parallel to its length. In some embodiments, the caps 300 are modular and can be removably coupled to the ends of the support roller 122. Alternatively, the caps 300 can be integrated with the support roller 122.

The main roller 124 can include the casings 302*a*, 302*b* (also called shells). The casings 302*a*, 302*b* can together form the main roller 124. When coupled, the casings 302*a*, 302*b* can form the main roller 124 including a cavity that can receive the incision mechanism 304 (e.g., a cutter). The incision mechanism 304 can extend along the length of the main roller 124 and can perforate the tissue 140 as it travels along the outer circumferential surface of the main roller 124. The perforations generated by the incision mechanism 304 can facilitate dispensing of the tissue 140 by reducing the amount of force needed to remove a portion of the tissue 140.

The casings 302*a*, 302*b* can include grippers 308*a*, 308*b*, respectively. The grippers 308*a*, 308*b* can include materials that may increase the amount of friction between the grippers 308*a*, 308*b* and the tissue 140. The increased amount of friction between the tissue 140 and the grippers 308*a*, 308*b* can allow the tissue 140 to remain in contact with the grippers 308*a*, 308*b* when the tissue 140 is being dispensed. The contact between the tissue 140 and the grippers 308*a*, 308*b* can advantageously allow the main roller 124 to rotate and allows the incision mechanism 304 to make incisions to the tissue 140. In some embodiments, the grippers 308*a*, 308*b* can include elastic materials that allow the grippers 308*a*, 308*b* to deform when compressed against, for example, the support roller 122, the guide 126, the dispense roller 128, or the guide extension 130.

As previously mentioned, the mechanism 120 can include covers 312*a*, 312*b*. The covers 312*a*, 312*b* can support (e.g., hold) the support roller 122, the main roller 124, and the dispense roller 128. For example, the support roller 122, the main roller 124, and the dispense roller 128 can be positioned between the covers 312*a*, 312*b*. The covers 312*a*, 312*b* can define sides of the dispensing mechanism 120. Each of the covers 312*a*, 312*b* can include securing features that receive axles associated with the support roller 122, the main roller 124, and the dispense roller 128. For example, as discussed in more detail below, the covers 312*a*, 312*b* can include elongated slots that receive an axle of the support roller 122. The guide extension 130 may be rotatably or fixedly connected to the covers 312*a*, 312*b*. As shown, the guide extension 130 can extend laterally between the covers 312*a*, 312*b* and/or can have a lateral width that is greater than or equal to a longitudinal length of the support roller 122 and/or main roller 124.

Support Roller

Figure 4:
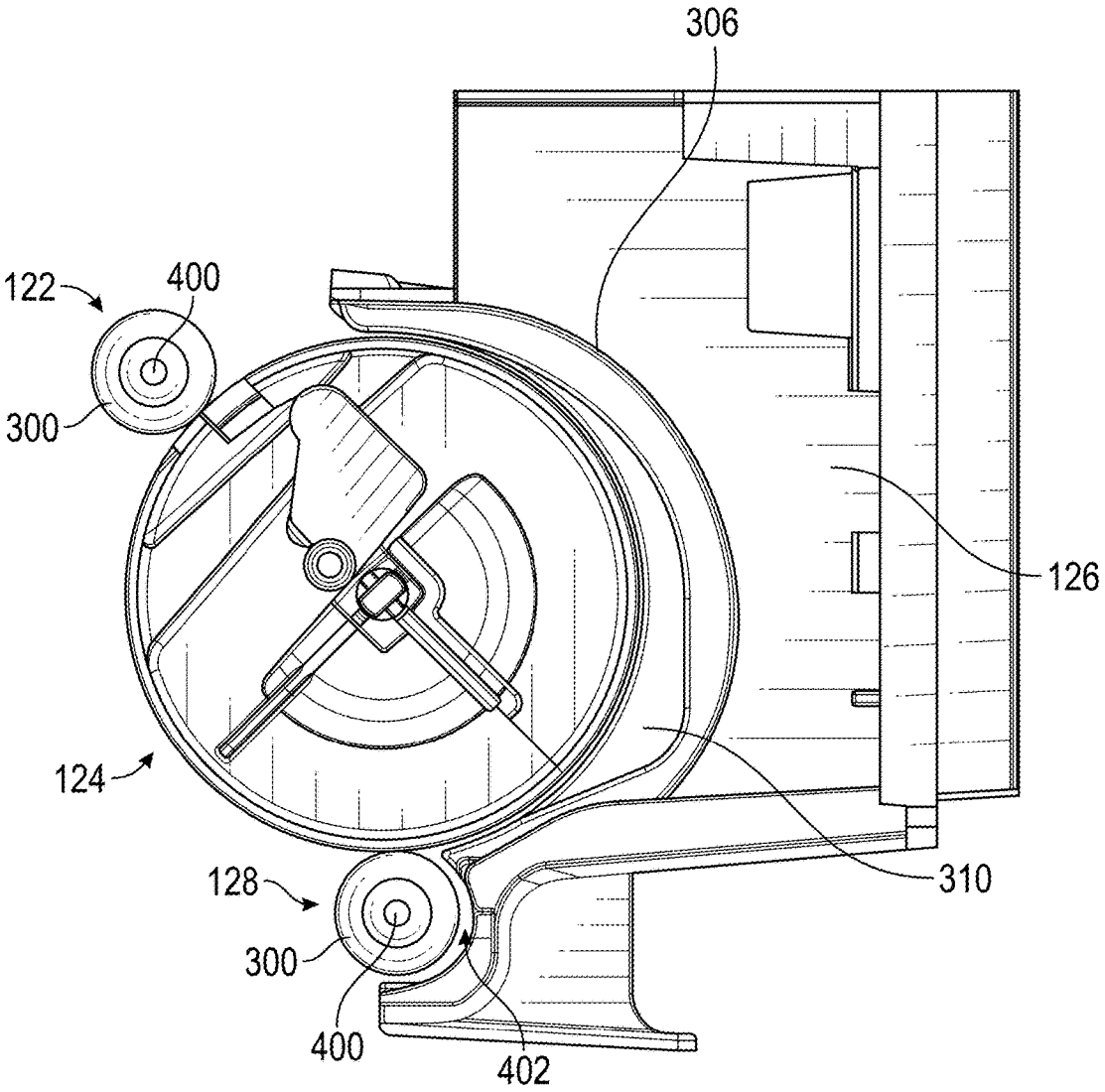
FIG. 4 illustrates a side view of the dispensing mechanism showing relative positions of various components. Some components of the dispensing mechanism have been removed to better illustrate the relative position of the components.

FIG. 4 illustrates a side view of the support roller 122, the main roller 124, the guide 126, and the dispense roller 128. Some of the components of the dispensing mechanism 120 (such as the covers 302*a*, 302*b* and the guide extension 130) have been removed to show the relative positions of the support roller 122, the main roller 124, the guide 126, and the dispense roller 128. As discussed in more detail below, the support roller 122 can be configured to float in the slot 130.

In the example shown in FIG. 4, the guide wall 306 of the guide 126 can extend circumferentially along and/or cover about half (for example, 50%) of the outer circumferential surface of the main roller 124. The dispense roller 128 can be positioned near the bottom portion of the guide 126 to receive the tissue 140 traveling from, for example, the top of the main roller 124 to the bottom of the main roller 124 along the outer circumferential surface of the main roller 124. In some embodiments, as shown in FIG. 4, the guide 126 can include a recess 402 that can receive the dispense roller 128. The distance between the guide 126 and the dispense roller 128 may be small to reduce the likelihood of the tissue 140 entering into the recess 402 between the dispense roller 128 and the guide 126.

Figure 5:
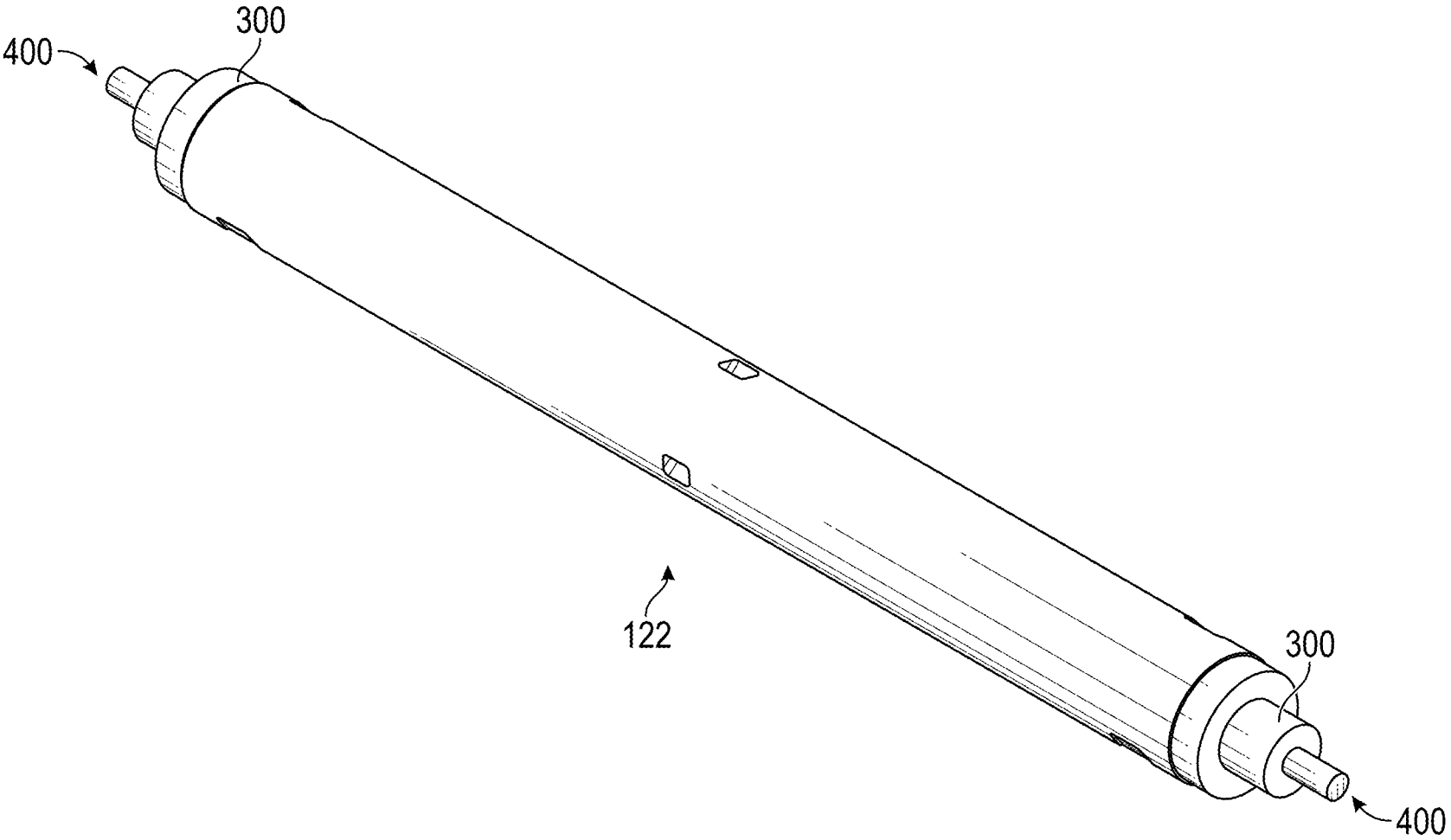
FIG. 5 illustrates a perspective view of a pinch roller of the dispensing system of FIG. 1A.

FIG. 5 illustrates a perspective view of the support roller 122. The support roller 122 can include, as discussed herein, the caps 300 coupled to the ends. The support roller 122 (e.g., the caps 300) can include an axle 400 that extends along an axis substantially parallel to the length of the support roller 122. Likewise, the dispense roller 128 can include the caps 300 that each include an axle 400 that extends along an axis substantially parallel to the length of the dispense roller 128.

Figure 6B:
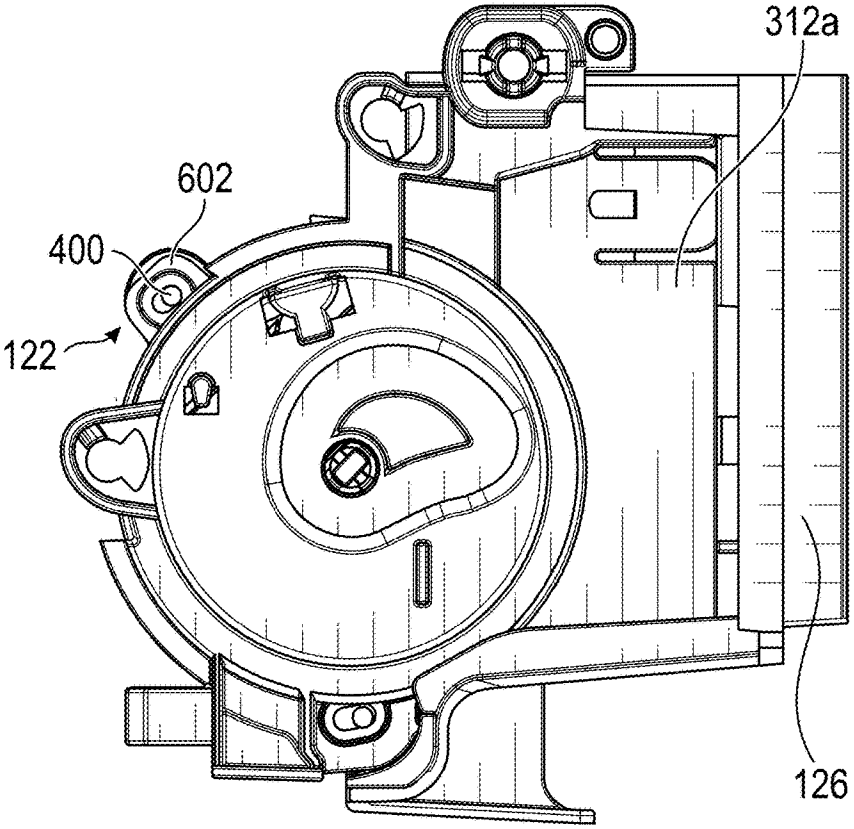
FIGS. 6A and 6B illustrate different positions of the pinch roller.
Figure 6A:
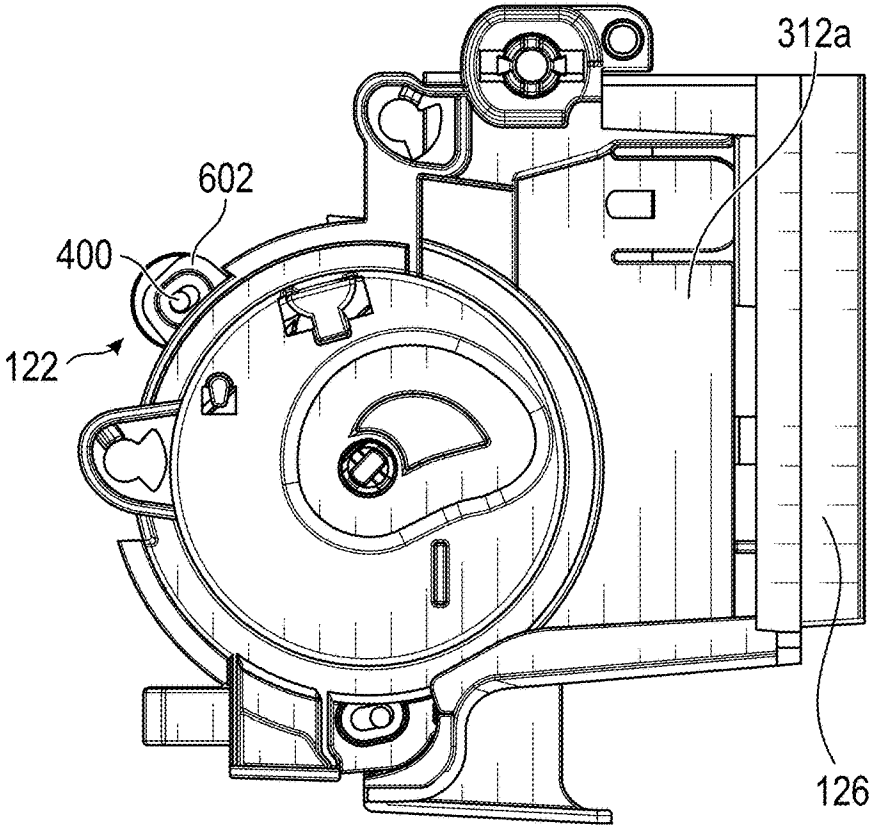

FIGS. 6A and 6B illustrate side views of the dispensing mechanism 120 showing different positions of the support roller 122. Some of the components of the dispensing mechanism 120 can include the guide extension 130 which have been removed to show the interaction between the support roller 122 and slots 604 (see FIG. 6C) of the covers 312*a*, 312*b*. The covers 312*a*, 312*b* can include a mounting region, such as a protrusion 602. The mounting region can include one or more support roller engagement elements, such as slots 604.

Figure 6C:
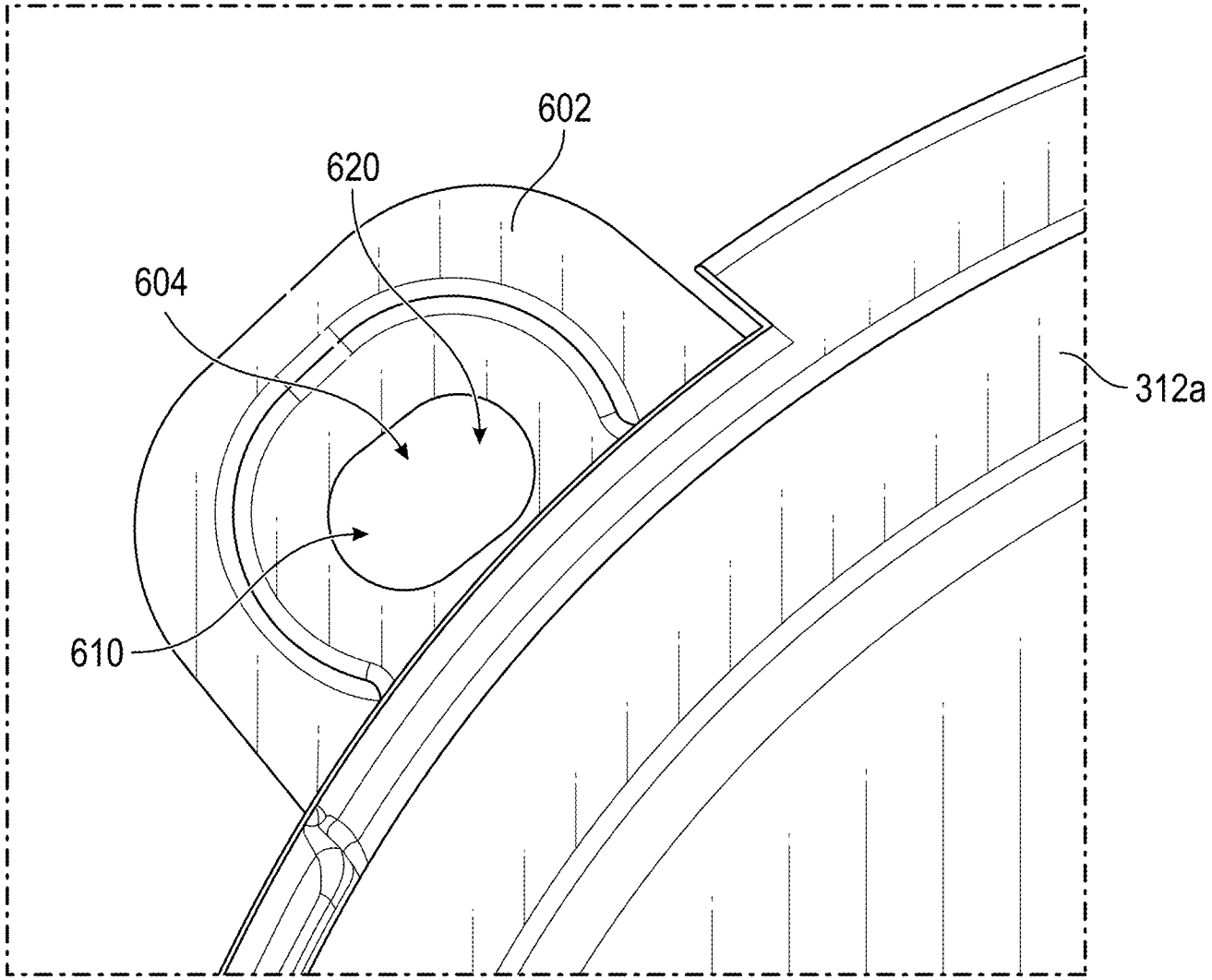
FIG. 6C illustrates a slot for receiving the pinch roller.

FIG. 6C illustrates a close-up view of the protrusion 602. The protrusion 602 can include a slot 604. The slot 604 may be dimensioned to receive the axle 400 of the support roller 122. The axle 400 may be able to rotate within the slot 604 to allow rotation of the support roller 122 about its axis of rotation, for example, defined by the axles 400. In some embodiments, the slot 604 may be elongated. For example, the slot can be oblong, elliptical, oval, or otherwise. The slot 604 can be straight along some or all of its length. For example, in some implementations, the slot 604 does not curve (e.g., to match the curve of the outer surface of the main roller, etc.). The slot 604 can include a first portion 610 and a second portion 620. As shown in FIGS. 6A and 6B, and as discussed in more detail below, the axle 400 of the support roller 122 may move between the first portion 610 and the second portion 620.

Figure 7B:
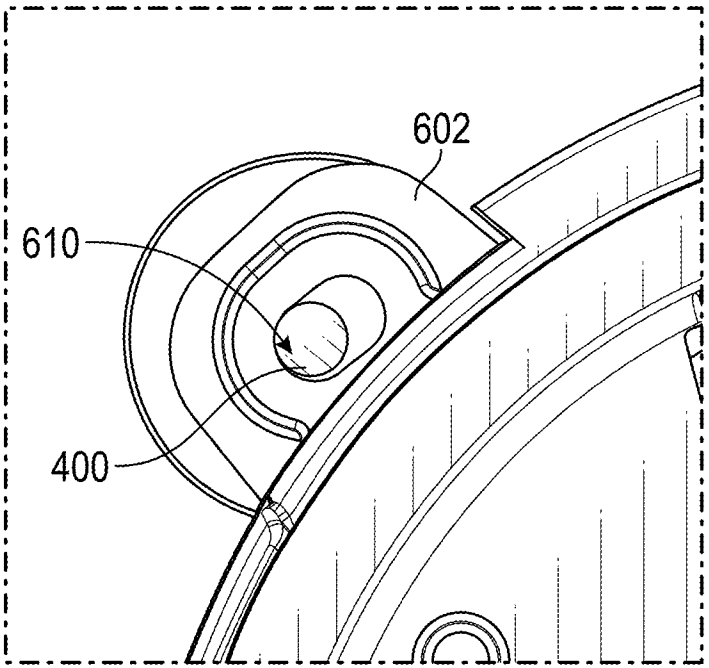
FIGS. 7A and 7B illustrate various views of the pinch roller in an unactuated position.
Figure 7A:
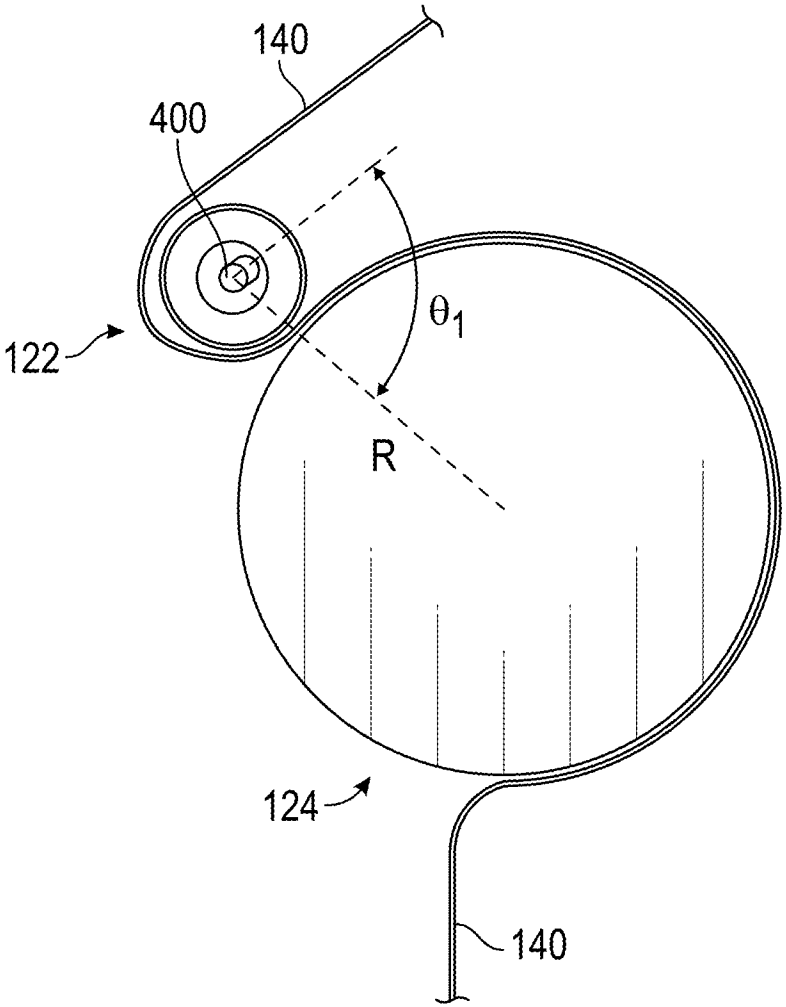

FIGS. 7A and 7B illustrate various views of the support roller 122 in an unactuated position (also called a first position). The unactuated position may be a first configuration of the support roller 122. When the support roller 122 is the unactuated position, the axles 400 of the support roller 122 may be positioned in the first portion 610 of the slot 604. As illustrated, then in the unactuated position, the tissue may be loose (e.g., not pinched) between the support roller 122 and the outer circumferential surface of the main roller 124. The support roller 122 may be in the unactuated position, for example, when the dispenser is at rest, when the dispenser is not dispensing tissue, and/or when a user is not pulling on a tail end of the tissue.

In some embodiments, the support roller 122 may be biased to the unactuated position. In the example embodiment shown in FIG. 6C, the second portion 620 of the slot 604 is located at a higher position than the first portion 610 of the slot 604. In certain embodiments, gravity biases the support roller 122 toward the first portion 610 (for example, towards the unactuated position). In some embodiments, the friction between the axles 400 and the inside edge of the slot 604 may be reduced or minimized to facilitate movement of the axles 400 of the support roller 122 from the second portion 620 to the first portion 610.

Figure 8B:
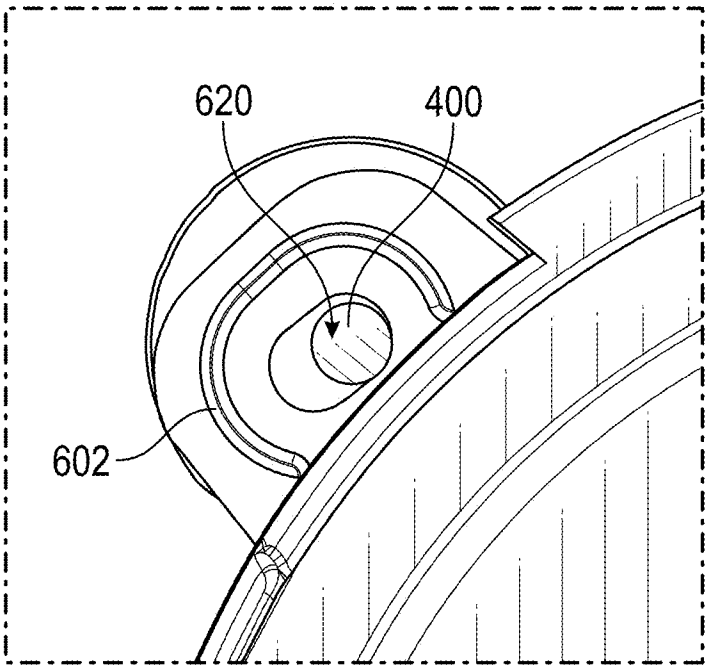
FIGS. 8A and 8B illustrate various views of the pinch roller in an actuated position.
Figure 8A:
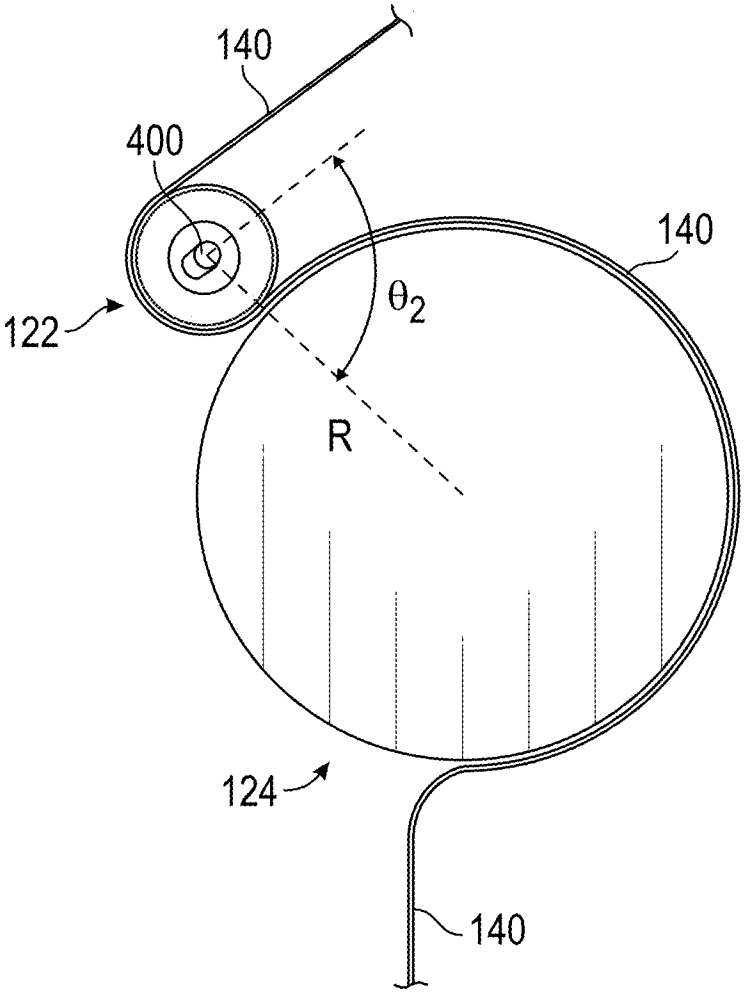

FIGS. 8A and 8B illustrate various view of the support roller 122 in an actuated position (also called a second position). The actuated position may be a second configuration of the support roller 122. When the support roller 122 is in the actuated position, the axles 400 of the support roller 122 may be positioned in the second portion 620 of the slot 604. When in the actuated position, the support roller 122 may pinch the tissue between the outer circumferential surface of the main roller 124. The support roller 122 may be in the actuated position, for example, when the dispenser is being used, when the dispenser is dispensing tissue, and/or when a user is pulling on a tail end of the tissue.

The support roller 122 may change (e.g., move, slide, etc.) from the unactuated position to the actuated position when the tissue 140 is pulled from the dispensing system 100. Before the tissue 140 is pulled (for example, not being dispensed from the dispensing system 100), there may be some slack of the tissue 140 near the support roller 122, for example, as shown in FIG. 7A. When the tissue 140 is being pulled from the dispensing system 100 (for example, a user pulling the tissue 140 to dispense at least a portion of the tissue 140 from the dispensing system 100), the slack of the tissue 140 near the support roller 122 may be removed or otherwise disappear, thereby causing the tissue 140 to be tightly wrapped around the support roller 122, for example, as shown in FIG. 8A. At this point (that is, when the tissue 140 is tightly wrapped around the support roller 122), continued pulling of the tissue 140 can increase the tension of the tissue 140 wrapped around the support roller 122 and urge the support roller 122 to move from the first portion 610 to the second portion 620. For example, the support roller 122 can be pushed or pulled (e.g., by the force applied via the tissue 140 and/or against the force of gravity) from the first position to the second position. As illustrated, in some embodiments, the support roller 122 is at or near one end of the slot 604 in the first position and at or near the opposite end of the slot 604 in the second position.

The dispenser system 100 can be configured such that the support roller 122 is drawn toward the main roller 124 during use, such as when tissue is being pulled from the system 100. This can drive (e.g., pinch and/or wedge) the support roller 122 and/or the tissue 140 into the main roller 124, and/or can apply a compressive force between the support roller 122 and the main roller 124. In some embodiments, such functionality is provided at least in part by the slot 604. With reference to FIGS. 7A and 8A, a longitudinal axis of the slot 604 can be oriented at an angle with respect to a radius R of the main roller 124. In some embodiments, this angle is about 90 degrees or less, such as about: 85 degrees, 83 degrees, 80 degrees, or otherwise. In certain implementations, the longitudinal axis of the slot 604 is not parallel to a line that is tangent to the outside circumferential surface of the main roller 124. For example, an angle between such a tangent and the longitudinal axis of the slot 604 can be greater than 0 degrees, such as at least about: 3 degrees, 5 degrees, 10 degrees, or otherwise. In some variants, the slot 604 is configured such that the distance between the support roller 122 and the tangent is greater when the support roller 122 is in the first position than in the second position. When the support roller 122 moves from the first position to the second position, the angle of the slot 604 tends to create and/or increase a compressive force between the rollers 122, 124. In several embodiments, the system 100 is configured such that the compressive force between the rollers 122, 124 is not created by a spring (e.g., a helical coil or torsion spring). In some implementations, a radial center of the support roller 122 is closer to the outer surface and/or radial center of the main roller 124 in the second position than in the first position.

In some embodiments, the first portion 610 of the slot 604 can be at a first angle $\theta_1$ with respect to the radius R of the main roller. The second portion 620 of the slot 604 can be at a second angle $\theta_2$ with respect to the radius R of the main roller. The first angle $\theta_1$ and the second angle $\theta_2$ may be the same or different. The first angle $\theta_1$ and the second angle $\theta_2$ may not be aligned with a tangent line of the outer circumference of the main roller 124. The first angle $\theta_1$ may be between about 70 degrees and 90 degrees, between about 72 degrees and about 88 degrees, between about 74 degrees and about 86 degrees, between about 76 degrees and about 84 degrees, between about 78 degrees and about 82 degrees, or about 70 degrees, about 72 degrees, about 74 degrees, about 76 degrees, about 78 degrees, about 80 degrees, about 82 degrees, about 84 degrees, about 86 degrees, about 88 degrees, about 90 degrees, or between any two of aforementioned values. The second angle $\theta_2$ may be between about 70 degrees and 90 degrees, between about 72 degrees and about 88 degrees, between about 74 degrees and about 86 degrees, between about 76 degrees and about 84 degrees, between about 78 degrees and about 82 degrees, or about 70 degrees, about 72 degrees, about 74 degrees, about 76 degrees, about 78 degrees, about 80 degrees, about 82 degrees, about 84 degrees, about 86 degrees, about 88 degrees, about 90 degrees, or between any two of aforementioned values. In some embodiments, as shown in the example illustrated in FIGS. 7A and 8A, the first angle $\theta_1$ may be about 80 degrees and the second angle $\theta_2$ may be about 83 degrees.

The second angle $\theta_2$ may advantageously be less than 90 degrees. In other words, the second portion 620 of the slot 604 may form an acute angle with respect to the radius R of the main roller 124. As such, when the support roller 122 moves from the unactuated position to the actuated position (that is, the axles 400 of the support roller 120 moves within the slot 604 from the first portion 610 to the second portion 620), the second angle $\theta_2$ of the second portion 620 drives the support roller 122 towards the main roller 124. In some embodiments, when the support roller 122 moves from the unactuated position to the actuated position, the support roller 122 may be wedged against the outer circumferential surface of the main roller 124.

When the tissue 140 is no longer being pulled, the support roller 122 may move from the actuated position to the unactuated position by a biasing force. For example, as discussed herein, in certain embodiments, the orientation and positions of the first portion 610 and the second portion 620 of the slot 604 can bias the support roller 122 to the unactuated position. According to some implementations, the support roller 122 is biased to the unactuated position by gravity. In several embodiments, the biasing force is not created by a spring (e.g., a helical coil or torsion spring). Less advantageous designs include a spring that biases the roller 122 into the unactuated position and that the user must overcome in order to move the support roller 122 to the actuated position. This increases the amount of pull force the user must apply to the tissue, which can be inconvenient and/or can increase the chance of the tissue ripping or otherwise suffering an improper dispensation. In contrast, certain embodiments of the system 100 do not use a spring to create the biasing force, and thus can reduce or avoid such drawbacks. The support roller 122 can be said to float in the slot 130. Similarly, in some embodiments, the dispense roller 128 can float in a slot. For example, certain embodiments have floating support and dispense rollers 122, 128. The floating rollers can be configured to each apply a compressive force on the main roller 126 during dispensing of the tissue 140.

In some embodiments, compression between the support roller 122 and the main roller 124 can urge the support roller 122 to the unactuated position. As discussed herein, the body of the support roller 122 can include elastomeric material such that the support roller 122 can be compressible. The support roller 122 can be radially compressible. The compressibility of the support roller 122 can advantageously facilitate the support roller 122 to be biased to the unactuated position. As discussed herein, when the support roller 122 is in the actuated position, the support roller 122 can be compressed or wedged against the outer circumferential surface of the main roller 124. When the support roller 122 is compressed or wedged against the outer circumferential surface of the main roller 124, the body of the support roller 122 can be compressed and generate a restoring force that can urge the support roller 122 to move toward the unactuated position. The restoring force can push the support roller 122 away from (e.g., apart from) the main roller 124.

In some embodiments, as discussed herein, the grippers 308*a*, 308*b* of the main roller 124 can include elastomeric material that can allow the grippers 308*a*, 308*b* to be compressed when pressed against, for example, the support roller 122. When compressed, the grippers 308A, 308*b* can generate a restoring force against, for example, the support roller 122 and urge the support roller 122 away from the main roller 124, thereby urging the support roller 122 to move from the actuated position to the unactuated position.

The movement of the support roller 122 from the actuated position to the unactuated position can retract at least a portion of the tissue 140. With reference to FIG. 8A, the main roller 124 can turn clockwise during dispensation and counterclockwise rotation at the end of dispensation (e.g., after the cutter has severed the tissue). At the end of dispensation, the release of pull force on the tissue in the system 100 can cause the movement of the support roller 122 from the actuated position to the unactuated position. In some embodiments, the rotation of the support roller 122 and/or main roller 124 can cause retraction of at least a portion of the tissue 140. In some embodiments, in response to the support roller 122 moving from the actuated position to the unactuated position, the restoring force pushing the support roller 122 away from the main roller 124, and/or the tissue 140 becoming slack between the rollers 122, 124, a tail end of the tissue 140 can be automatically slightly retracted toward an outlet of the dispenser 100. This can provide a desirable visual effect for the user. In various embodiments, the tissue 140 is retracted by a distance of less than or equal to about 25 mm and/or less than or equal to half of the circumference of the support roller 122.

Guide Extension

As previously discussed herein, the guide 126 can include the fins 310. The fins 310 can extend radially away from the guide wall 306 and/or in a circumferential direction along the guide wall 306. The guide 126 can be positioned proximate to the main roller 124 and facilitate movement of the tissue 140 around the main roller 124 by urging the tissue 140 towards the outer circumferential surface of the main roller 124. Accordingly, it is desirable to have the guide 126 extending over and/or covering the outer circumferential surface of the main roller 124 between the support roller 122 and the dispense roller 128. This can facilitate or ensure that the tissue 140 remains proximate to the outer circumferential surface of the main roller 124. Without the guide 126, the tissue 140 can, for example, bend away from the main roller 124 and be torn or crumpled. The torn or crumpled tissue can be lodged within the dispensing mechanism 120 and prevent the tissue 140 from being dispensed.

The guide 126 may be manufactured using injection molding. Injection molding can be beneficial for manufacturing components such as the guide 126 because it allows add a large amount of detail to be added into the design of a part. In addition, injection molding provides high manufacturing efficiency since many parts can be manufactured from a single mold in a short amount of time. Furthermore, injection molding can be done using different fillers that would increase the strength of the manufactured parts and sometimes with different types of plastic.

However, injection molding can be difficult if a part or component to be manufactured includes one or more undercuts. Undercuts are features in an injection-molded part that inhibit or prevent ejection of the part from the mold. In some embodiments, the support roller 122 and the dispense roller 128 may be positioned such that the tissue 140 travels along more than the half of the circumference of the main roller 124, as shown in FIGS. 7A, 8A, and 9B. In such instances, it would be desirable for the guide 126 to cover more than half of the outer circumference of the main roller 124. However, this would mean that the guide 126 covers more than half of the outer circumference of the main roller 124, which would create an undercut. Injection molding such a guide would be difficult because the fins 310 would prevent ejection (for example, in an axial direction along the length of the guide 126) of the guide 126 from its mold.

As mentioned above, the dispensing system 100 can include the guide extension 130. The guide extension 130 can be a separate component from the guide 126. Thus, the guide extension 130 can manufactured separately from the guide 126. By utilizing the guide extension 130, the guide 126 (e.g., covering about the half of the circumference of the main roller 124) can be manufactured without the undercut and attendant injection molding problems.

The guide extension 130 can be positioned in a circumferential space between the support roller 122 and the guide 126. The guide extension 130 can extend the circumferential length of guiding of the tissue 140 around the main roller 124. For example, in some embodiments, the guide extension 130 cooperates with the guide 126 to guide the paper around more than 180 degrees of the circumference of the main roller 124, such at least about: 210 degrees, 235 degrees, 270 degrees, or otherwise. In some embodiments, the guide extension 130 and the guide 126 surround the outer circumference of the main roller 124 and defines a wrap angle of the tissue 140 around the outer circumference of the main roller 124. The wrap angle of the tissue 140 can be a degree at which the tissue 140 wraps around the outer circumference of the main roller 124. For example, the tissue 140 may wrap around more than 180 degrees of the outer circumference of the main roller 124 (for example, about 210 degrees, 235 degrees, 270 degrees, or otherwise) as shown in FIGS. 7A and 8A. The guide 126 and the guide extension 130 can surround (for example, wrap around) portions of the outer circumference of the main roller 124 at about the wrap angle of the tissue 140. As shown in FIG. 1B, the guide 126 and the guide extension 130 can surround (for example, wrap around) portions of the outer circumference of the main roller 124 wrapped by the tissue 140. Various embodiments have guide surfaces surrounding the outer circumferential surface of the main roller 124 using both the guide 126 and the guide extension 130.

Figure 9A:
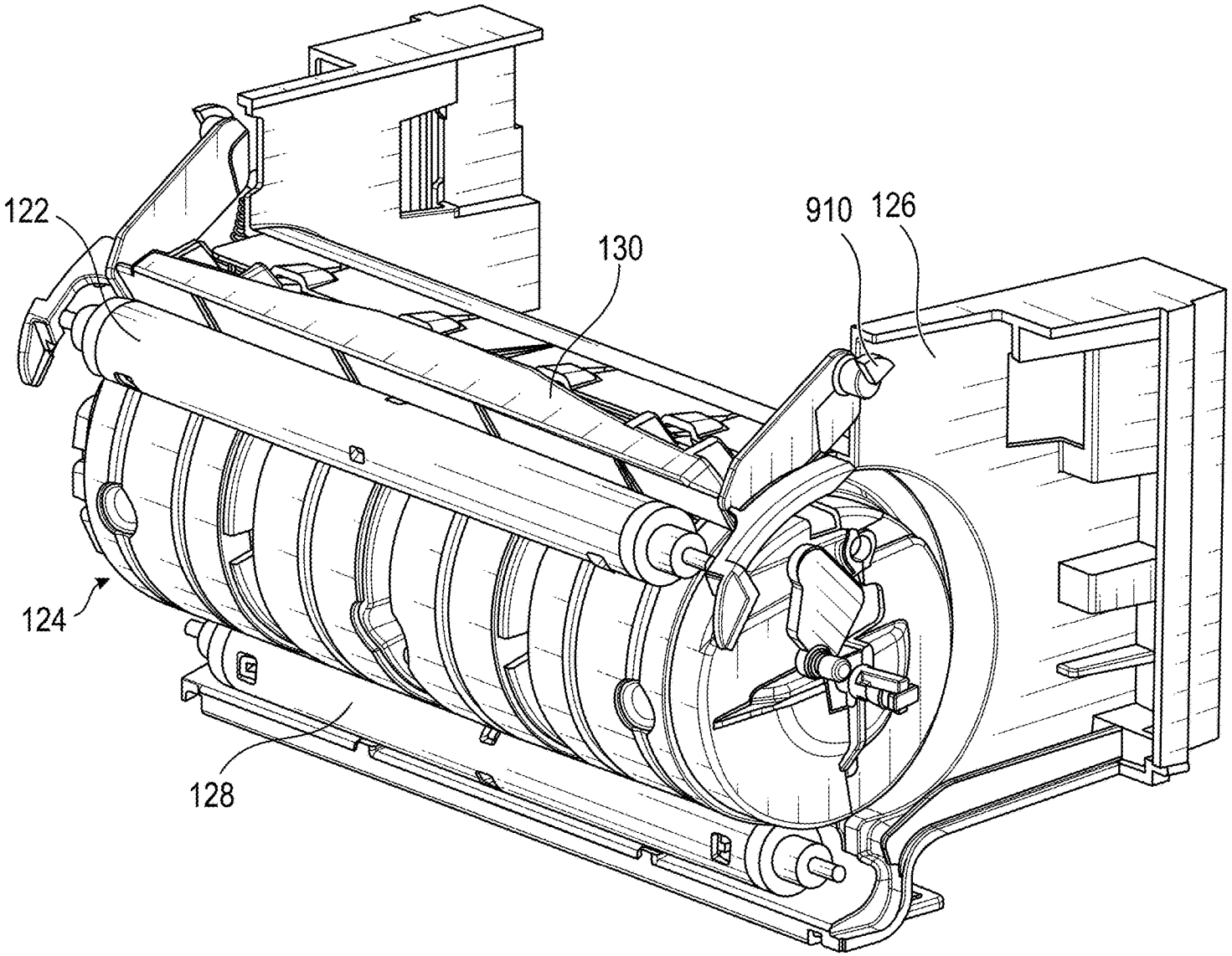
FIGS. 9A and 9B illustrate various views of the dispensing mechanism showing relative position of a guide extension with respect to a guide and the pinch roller. Some components of the dispensing mechanism have been removed to better illustrate the relative position of the guide extension.
Figure 9B:
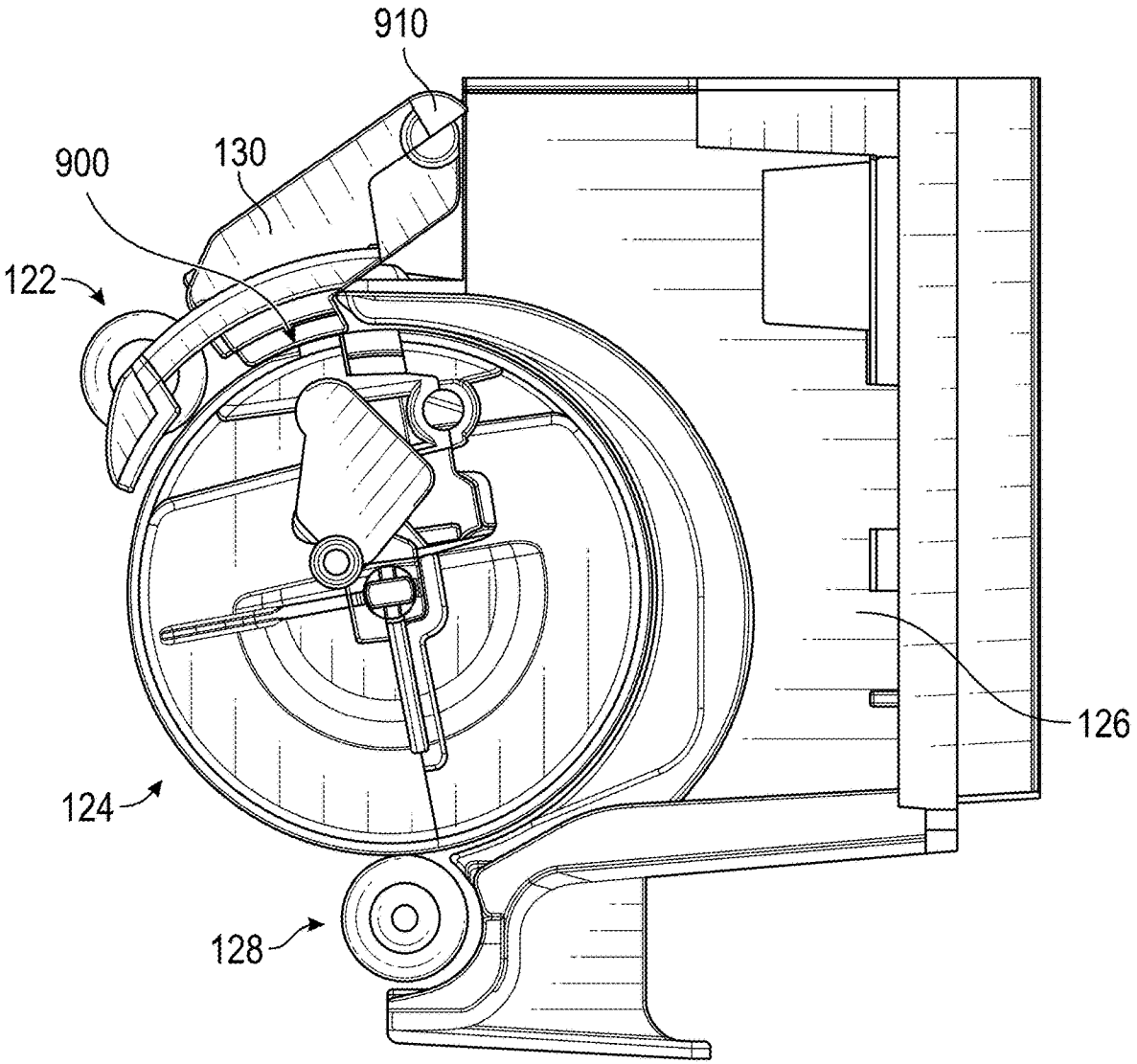

FIGS. 9A and 9B illustrate various views of the guide extension 130. Some components of the dispensing mechanism, such as the covers 312*a*, 312*b*, have been removed to illustrate relative positions of the support roller 122, the main roller 124, the guide 126, the dispense roller 128, and the guide extension 130. As shown in FIG. 9A, the support roller 122 and the dispense roller 128 may be positioned along the outer circumference of the main roller 124 (for example, about 210 degrees from each other) such that the tissue 140 travels along more than half of the outer circumference of the main roller 124. The guide 126, as discussed above, can cover about the half of the outer circumference of the main roller 124. In some embodiments, the guide extension 130 can cover (e.g., extend circumferentially between) substantially all the remaining outer circumference of the main roller 124 between the guide 126 and the support roller 122. This can increase control of the tissue 140 (e.g., to facilitate moving, cutting, etc.) and/or can reduce the chance of the tissue 140 becoming loose, torn, or caught in the circumferential space between the support roller 122 and the guide 126. For example, cutting error due to the tissue moving away from the cutter blade can be reduced.

The guide extension 130 can include a guide wall 900 that can extend along the length of the main roller 124. The guide wall 900 of the guide extension 130 can face towards the outer circumferential surface of the main roller 124 and/or can press the tissue 140 toward the outer circumferential surface of the main roller 124. The guide extension 130 can be positioned between the support roller 122 and the guide 126. The guide extension 130 provides additional guiding surface (for example, the guide wall 900) that can urge the tissue 140 towards the main roller 124 as the tissue 140 moves between the support roller 122 and the dispense roller 128.

Figure 9C:
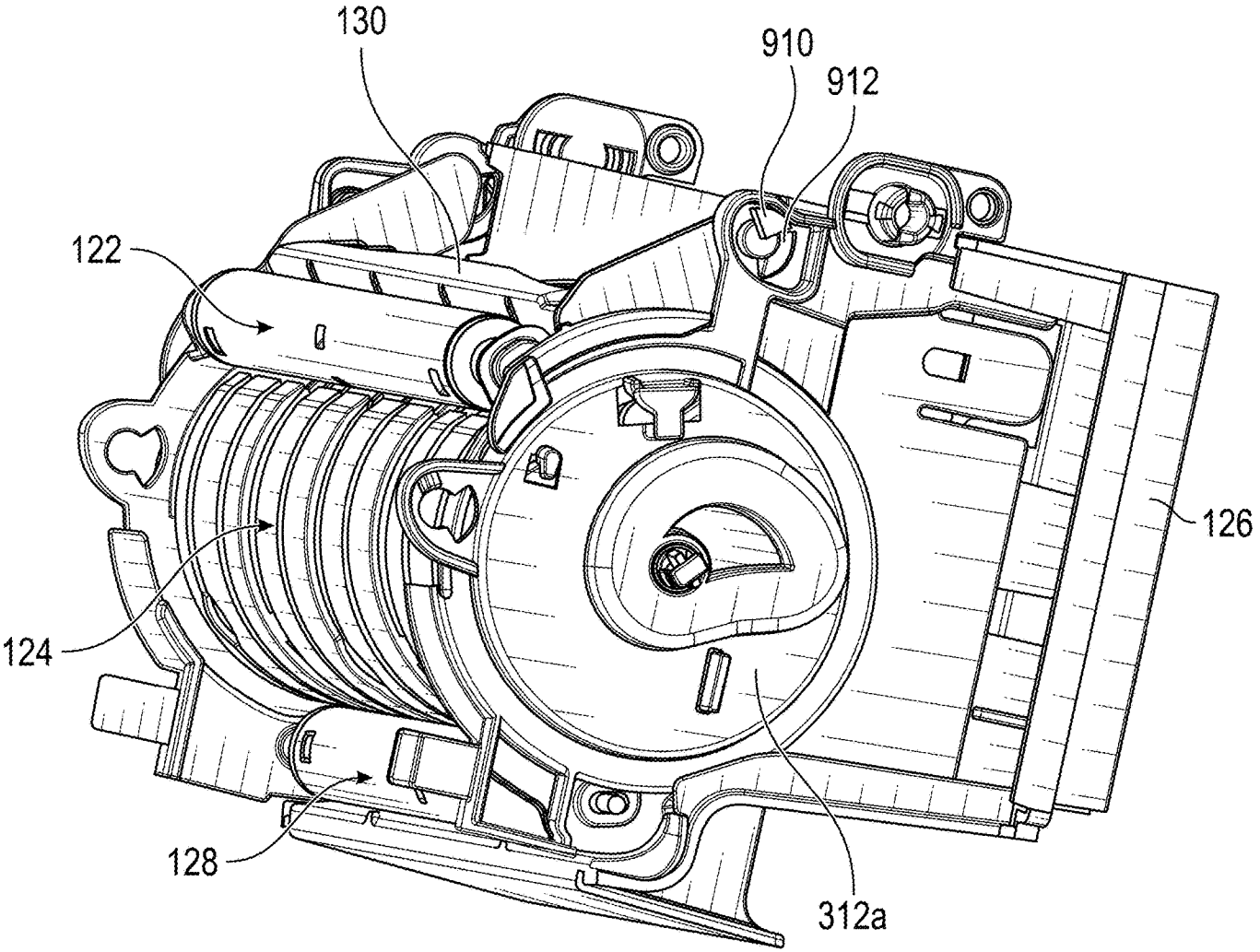
FIG. 9C illustrates a perspective view of the dispensing mechanism showing coupling between the guide extension and a side frame.
Figure 9D:
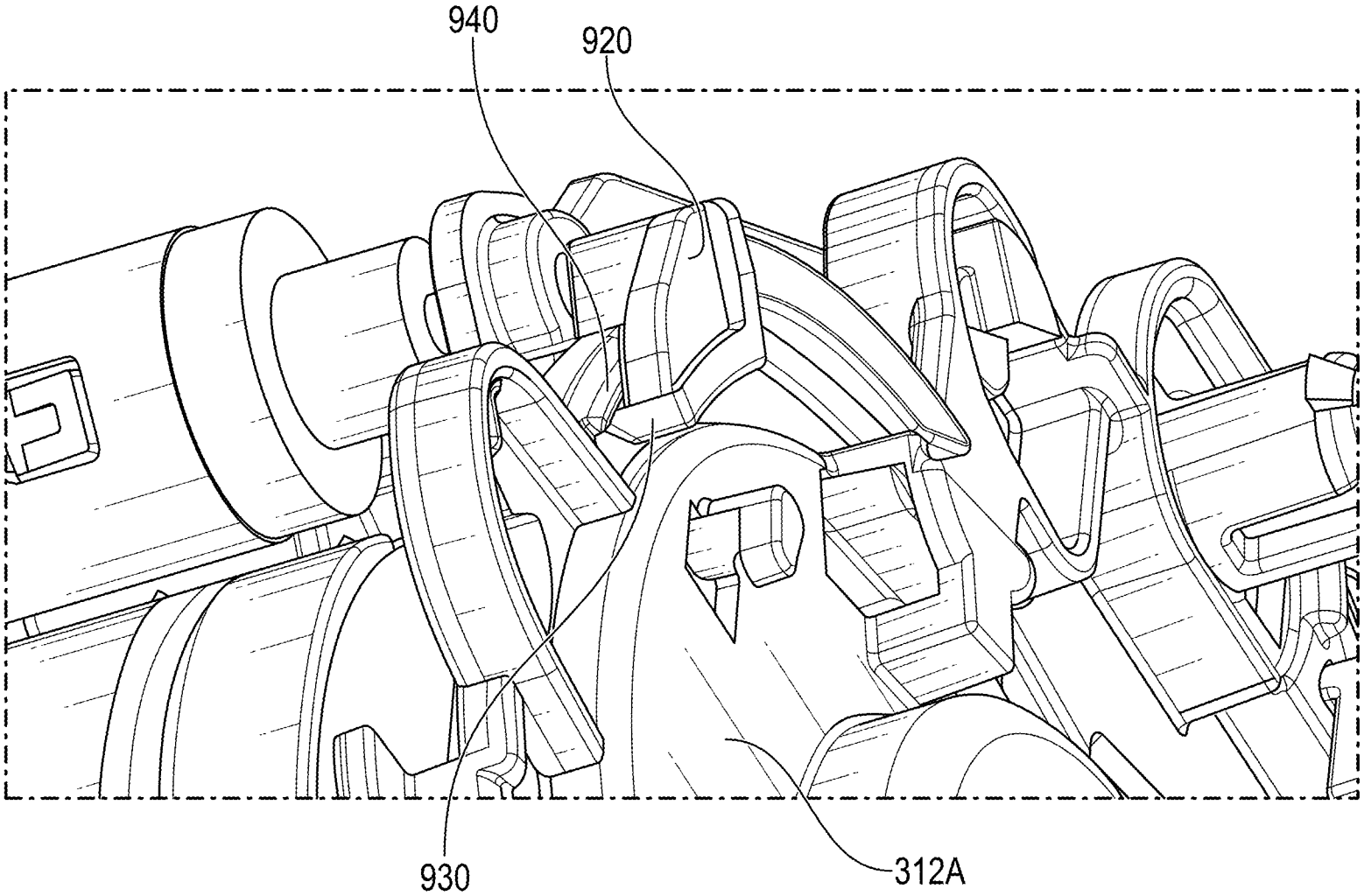
FIG. 9D illustrates another perspective view of the dispensing mechanism showing coupling between the guide extension and a side frame.

FIGS. 9C and 9D illustrate a connection between the guide extension 130 and other components of the dispensing mechanism 120. The guide extension 130 can directly or indirectly connect to the guide 126. The guide extension 130 can be modular and can removably connect to the guide 126, such as with a snap connection. In some embodiments, the guide extension 130 may be removably connected to the covers 312*a*, 312*b* and the covers 312*a*, 312*b* can be connected to the guide 126. In various embodiments, the guide extension 130 and guide 126 are rigidly connected and/or move as a unit. For example, in some variants, in intended use and operation, the guide extension 130 does not pivot relative to the guide 126.

The guide extension 130 can include a pin 910. The pin 910 can be inserted into an opening 912 of the covers 312*a*, 312*b*. In some embodiments, the opening 912 of the covers 312*a*, 312*b* can include a slot in a particular orientation such that the pin 910 of the guide extension 130 can be inserted at a certain orientation into the opening 912 via the slot. In certain implementations, once the pin 910 is inserted into the opening 912, the guide extension 130 can rotate about the pin 910 and the opening 912. The guide extension 130 can further include a leg 902 comprising a first lip 930. The cover 312*a* (or cover 312*b*) can include a second lip 940. As the guide extension 130 is brought closer to the main roller 124, the first lip 930 of the guide extension 130 can be brought past the second lip 940 of the cover 312*a*. Once the first lip 930 is brought past the second lip 940 (for example, brought closer to the main roller 124), the second lip 940 may prevent further rotation of the guide extension 130 (for example, away from the main roller 124) by abutting against the first lip 930.

Figure 10A:
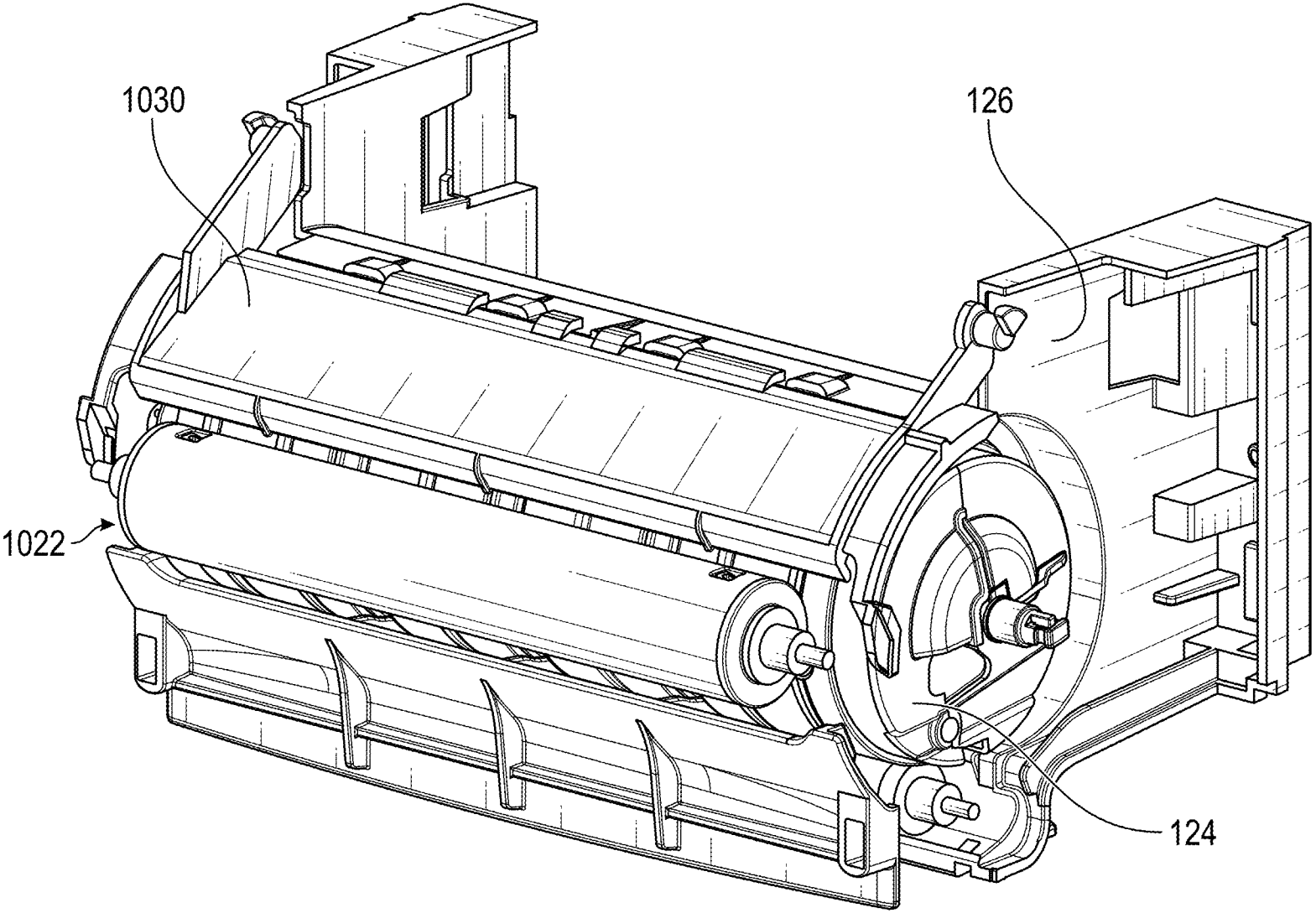
FIGS. 10A and 10B illustrate various views of a variant of the dispensing mechanism showing relative position of the guide extension with respect to the guide and the pinch roller. Some components of the dispensing mechanism have been removed to better illustrate the relative positions.
Figure 10B:
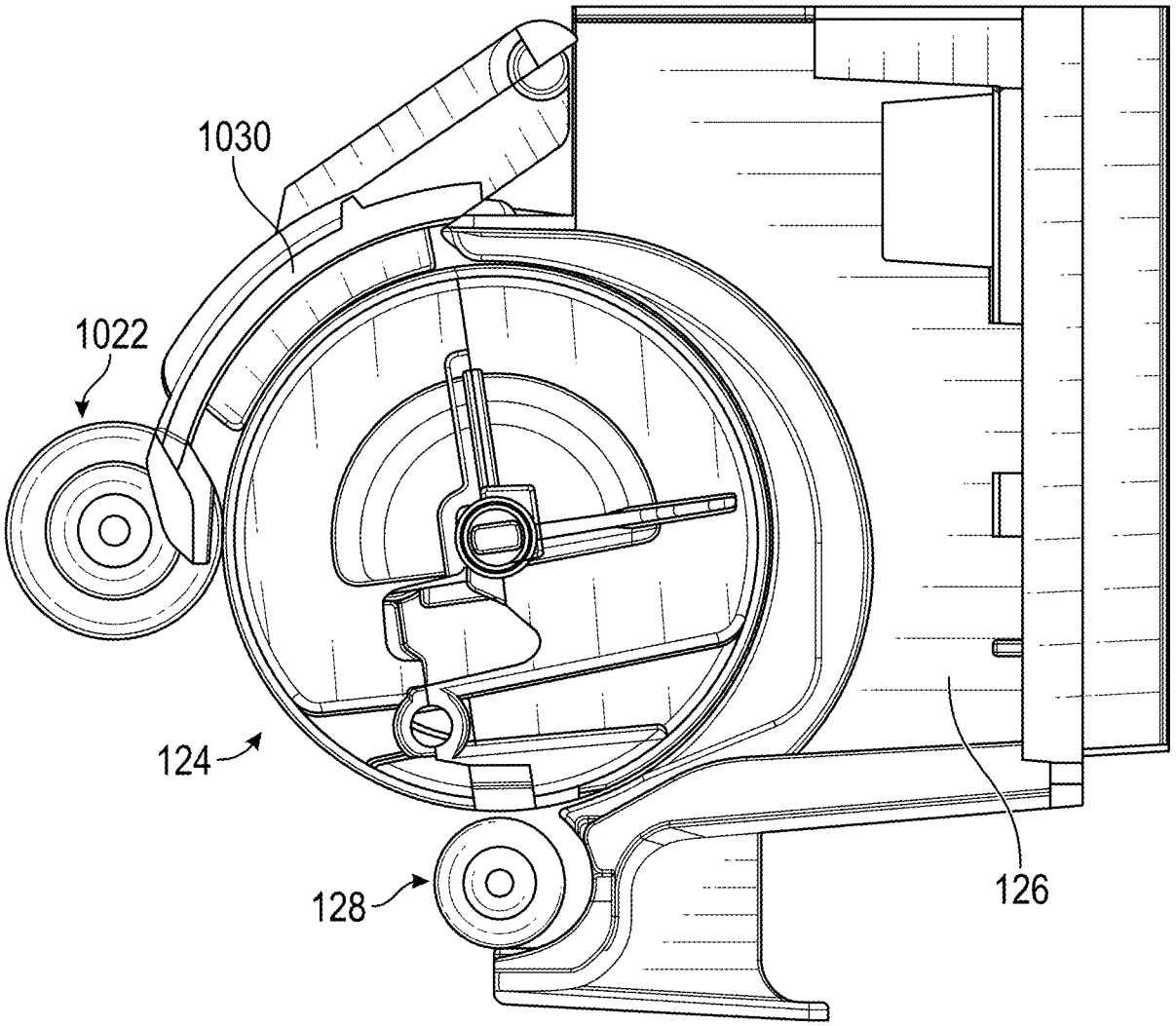

FIGS. 10A and 10B illustrate a variation of the system 100 having a support roller 1022 is that is located circumferentially further apart from the guide 126 and a guide extension 1030 that has been correspondingly increased in size. As shown in FIG. 10B, the support roller 1022 and the dispense roller 128 can be positioned along the outer circumference of the main roller 124 (for example, at least about 270 degrees from each other) such that the tissue 140 travels along about three fourths of the outer circumference of the main roller 124. The guide 126, as discussed above, can cover about the half of the outer circumference of the main roller 124 while the guide extension 130 can cover substantially the remaining outer circumference of the main roller 124 between the guide 126 and the support roller 122. This embodiment illustrates, for example, that the guide extension can be adjusted (e.g., the circumferential extent) to correspond to various configurations of the support roller 122 and the guide 126.

Rotation System

Figure 11A:
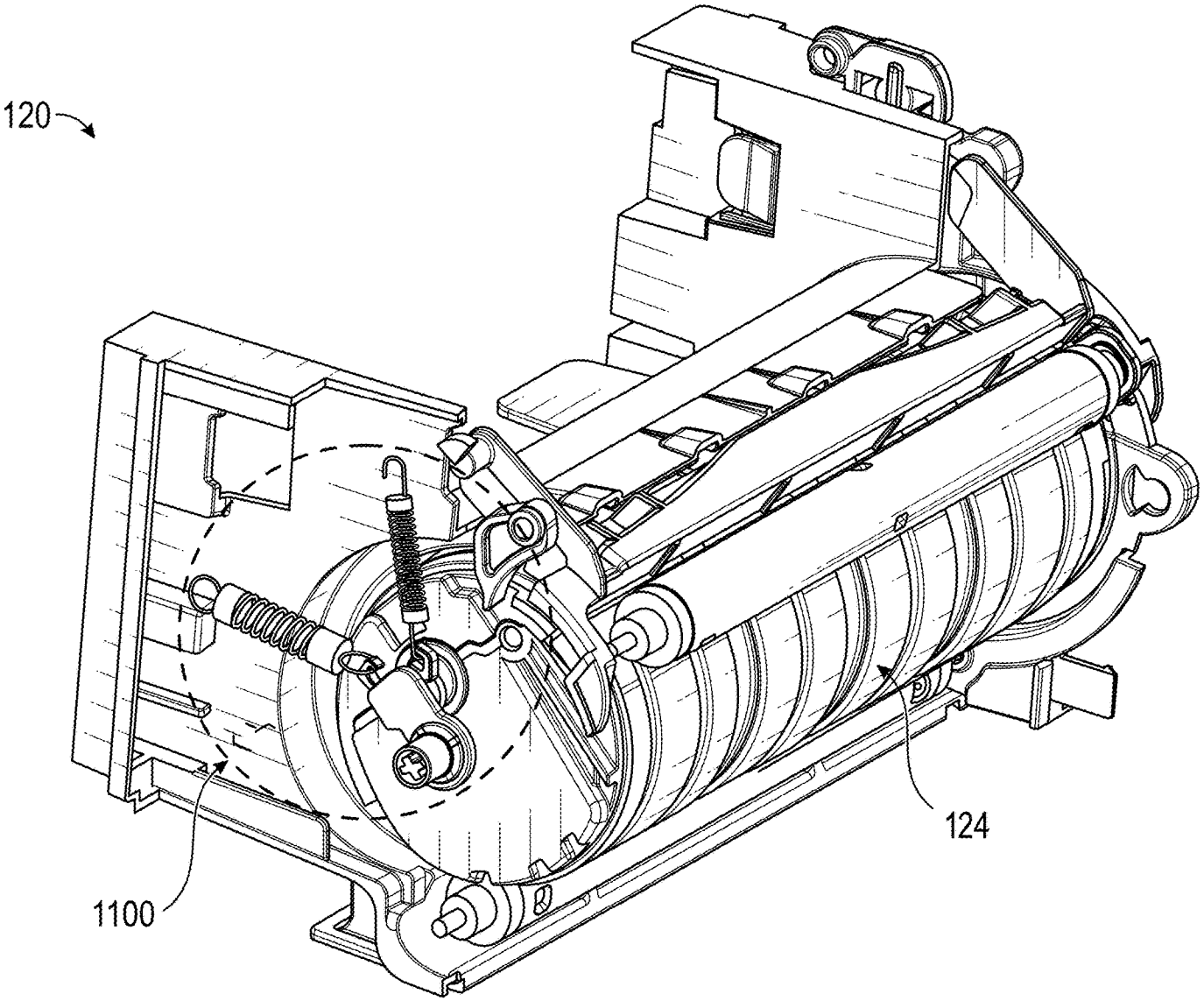
FIGS. 11A and 11B illustrate various views of a rotation system of the dispensing mechanism of FIG. 1.
Figure 11B:
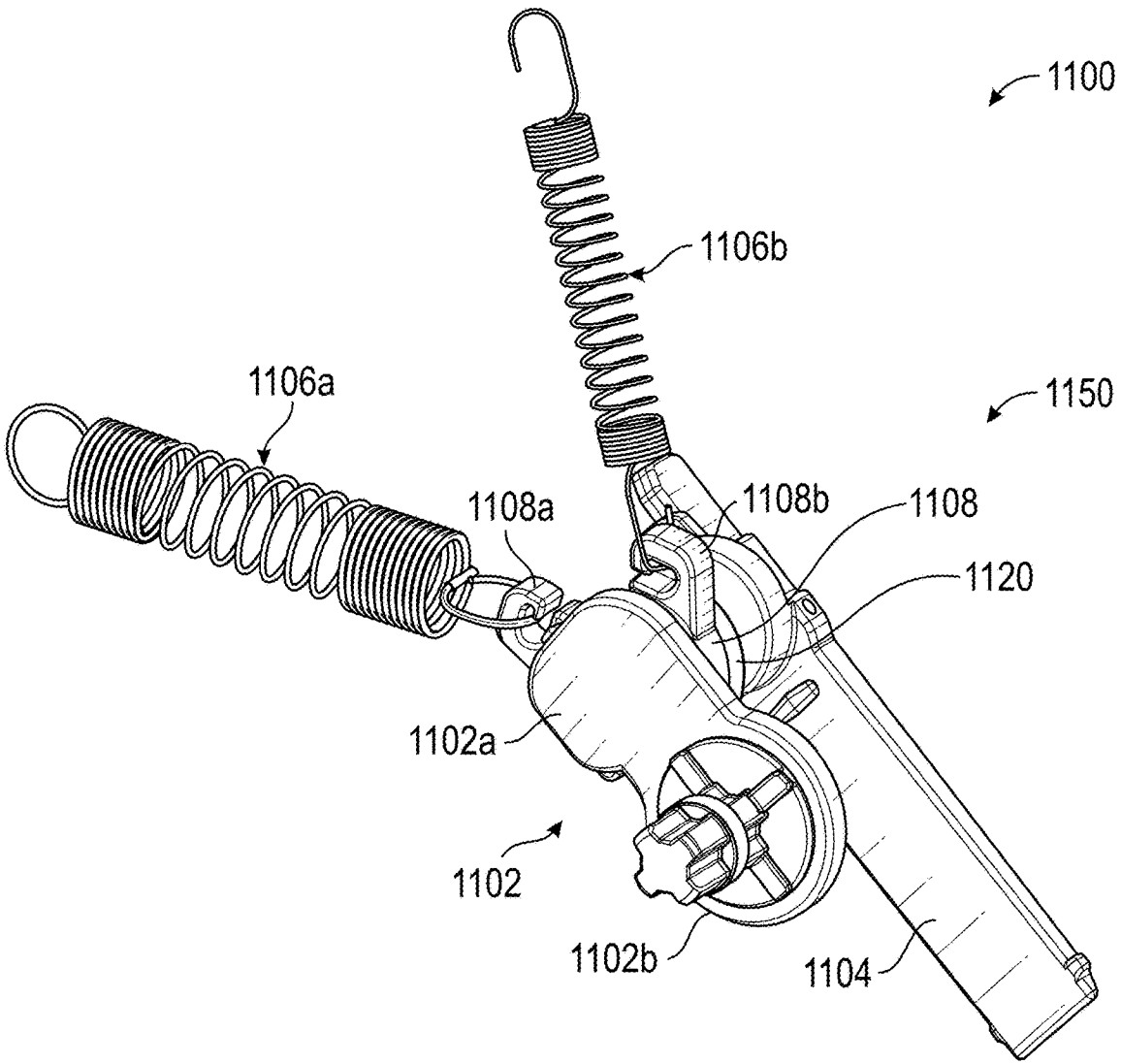

FIGS. 11A and 11B illustrate various view of a rotation system 1100 of the dispensing mechanism 120. The rotation system 1100 can facilitate advancing of a tail of the tissue 140 for users. The tail can be a portion of the tissue 140 that hangs from the dispensing system 100. By facilitating advancement of the tail of the tissue 140, the rotation system 1100 can help users to grab the tail and pull the tissue 140 from the dispensing system 100 with more ease. In various embodiments, as the user pulls on the existing tail, one or more biased members (e.g., springs) get energized (e.g., stretched). This stores energy that will be used to advance a tail after the tissue sheet is severed by the cutter (e.g., a cam driven blade).

The rotation system 1100 can be connected to an axial side of the main roller 124. The rotation system 1100 can include a rotation member 1150, a first biased member 1106*a*, and a second biased member 1106*b*. The rotation member 1150 can include an outer base 1102, an inner base 1104, a shaft 1120, and/or a support 1108. The support 1108 can comprise a first fastener 1108*a* and a second fastener 1108*b*. The inner base 1104 can be fixedly connected to the main roller 124 such that rotation of the main roller 124 can directly translate to rotation of the inner base 1104. The inner base 1104 may be referred to as a drum crank (or roller crank) that can rotate the main roller 124 about its rotational axis. The outer base 1102 can be connected to the inner base 1104 via a shaft 1120 extending between the outer base 1102 and the inner base 1104 such that rotation of the inner base 1104 (for example, caused by rotation of the main roller 124) is translated to the outer base 1102. The outer base 1102 can include a first portion 1102*a* and a second portion 1102*b*. The second portion 1102*b* can be positioned along the axis of rotation of the main roller 124 such that rotation of the main roller 124 can translate into rotation of the first portion 1102*a* about the second portion 1102*b*. In certain variants, the second portion 1102*b* rotates, for example with the first portion 1102*a*. In some embodiments, shaft 1120 is configured to rotate about the axis of rotation of the main roller 124.

The shaft 1120 extending between the inner base 1104 and the outer base 1102 can be offset from the rotational axis of the main roller 124. The shaft 1120 can function as an offset axis (for example, an axis offset from the rotational axis of the main roller 124) for the biasing members 1106*a*, 1106*b*. The biased members 1106*a* 1106*b* can be connected to the shaft 1120 via the fasteners 1108*a*, 1108*b*, respectively. The first fastener 1108*a* and the second fastener 1108*b* can be rotatably connected to the shaft 1120.

As the main roller 124 rotates about its axis of rotation, as discussed herein, the shaft 1120 can also rotate around, for example, about the axis of rotation of the main roller 124. The first fastener 1108*a* and the second fastener 1108*b* can be rotatably coupled to the shaft 1120 such that the shaft 1120 of the rotation member 1150 can rotate about the axis of rotation of the main roller 124 without the biased members 1106*a*, 1106*b* being tangled.

As a user pulls on the tail of the tissue 140, the contact between the outer circumferential surface of the main roller 124 and the tissue 140 can cause the main roller 124 to rotate. As discussed herein, rotation of the main roller 124 can cause the rotation of the rotation member 1150, which can cause rotation of the shaft 1120, for example, about the axis of rotation of the main roller 124. Since the shaft 1120 is connected to the biasing members 1106*a*, 1106*b* via the fasteners 1108*a*, 1108*b*, rotation of the main roller 124 (which causes rotation of the shaft 1120) can stretch the biasing members 1106*a*, 1106*b* while the user pulls on the tail of the tissue 140. In other words, the displacement of the tail of the tissue 140 (for example, a user pulling the tissue 140) can cause the biased members 1106*a*, 1106*b* to stretch and exert restoring force to the main roller 124.

When the tissue 140 is no longer being pulled (for example, after a portion of the tissue 140 is dispensed), the restoring force from the stretched biased members 1106*a*, 1106*b* can cause rotation the shaft 1120 of the rotation member 1150, which can cause rotation of the main roller 124. The restoring force from the biased members 1106*a*, 1106*b* can cause the main roller 124 to rotate after the tissue 140 has been dispensed, which can cause the tail of the tissue 140 to advance further (that is, extending further out from the dispensing system 100). This can allow users to pull the tail of the tissue 140 with more ease. Having addition biased members (for example, more than one) can increase the amount of restoring force exerted on the main roller 124 and cause the main roller 124 to rotate faster after a portion of the tissue 140 is dispensed. This increase in the amount of restoring force can advantageously cause the tail of the tissue to advance further.

Additionally, the rotation system 1100 can address issues with "stalling." For example, in a system with a single spring, the main roller (also called a drum) can stall in that position if, for example, the dispense roller loses contact with the tissue and the tissue slips instead of helping to rotate the main roller. In that situation, a user may have to turn the feed knob or push the push bar to advance the tissue because, even though the spring is fully stretched, all of the force applied by the spring is in line with the drum crank (e.g., the inner base 1104) and/or a drum axis (e.g., a longitudinal axis of the inner base 1104), so there is no torque available to rotate the drum. In several embodiments, the rotation system 1100 includes multiple springs, which can reduce or avoid this issue. For example, the springs can apply force in different directions and/or at different angles, which ensures there is torque available to rotate the drum and/or avoids the issue of the force applied by a single spring being aligned with the center axis of the drum. Having multiple springs and/or applying force in different directions can offer adjustability in that the springs can have different tensions to further tune or avoid the stall condition.

In some embodiments, the rotation system 1100, as shown in FIGS. 11A and 11B, includes a plurality of (e.g., two) biased members 1106*a*, 1106*b*. This can inhibit or prevent the main roller 124 from being stuck in certain angular positions. When the rotation system 1100 includes just one biased member (for example, the first biased member 1106*a*), the biased member 1106*a* can sometimes align with the positions of the movable portion 1102*a* and the stationary portion 1102*b*. In other words, when the length of the outer base is aligned with, for example, the first biased member 1106*a*, the first biased member 1106*a* may not be able to urge the main roller 124 to rotate back to its initial position. Although the single biased member can be installed in a certain position relative to the main roller 124 to reduce the likelihood of the main roller 124 getting stuck, having two biased members 1106*a*, 1106*b* can provide increased flexibility for the positions of the biased members (that is, locations where the biasing members 1106*a*, 1106*b* are connected to in addition to the shaft 1120). Moreover, by having two biased members, the rotation system 1100 can urge the main roller 124 to its initial position even when one of the biased members is aligned with the outer base 1102.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

The technology of the present disclosure has been discussed in the context of certain embodiments and examples. The technology extends beyond the specifically disclosed embodiments to other alternative embodiments and/or uses of the embodiments and certain modifications and equivalents thereof. For example, although certain embodiments are disclosed in the context of a manually-operated dispenser, the technology can be applied to motorized dispensers too. The dispensing systems and methods disclosed herein can include any feature from any of U.S. Pat. Nos. 6,553,879; 7,500,420; 8,424,431; and 10,271,695, which are incorporated by reference herein in their entirety, but shall not be used for construing the claims herein. Any two or more of the components of the dispenser system can be made from a single monolithic piece or from separate pieces connected together. Various features and aspects of the disclosed embodiments can be combined with or substituted for one another in order to form varying modes of the invention. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale is not limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of dispensing systems and related methods have been disclosed. Although the dispensing systems have been disclosed in the context of those embodiments and examples, the technology of this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. A dispensing system comprising:

a housing;

a roll support arm in the housing; and a dispensing mechanism in the housing, the dispensing mechanism configured to enable dispensing of tissue from a roll mounted on the roll support arm, the dispensing mechanism comprising:

a main roller; and a support roller configured to move from a first position to a second position in response to a user pulling on a tail end of the tissue, wherein the support roller is biased towards the first position and applies a compressive force to the main roller when in the second position.

2. The dispensing system of claim 1, wherein:

the dispensing mechanism comprises a support frame with an elongated slot configured to receive the support roller, the elongated slot having a first portion at one end and a second portion at an opposite end;

the support roller is configured to move along the elongated slot in a circumferential direction relative to the main roller;

the support roller is in the first portion of the elongated slot when the support roller is in the first position; and the support roller is in the second portion of the elongated slot when the support roller is in the second position.

3. The dispensing system of claim 2, wherein the slot is dimensioned such that the support roller is biased towards the first portion.

4. The dispensing system of claim 2, wherein the slot is dimensioned such that:

the compressive force increases when the support roller moves from the first portion to the second portion; and the compressive force decreases when the support roller moves from the second portion to the first portion.

5. The dispensing system of claim 1, wherein the support roller is configured to slide in the slot.

6. The dispensing system of claim 1, wherein the first position of the support roller is associated with a resting position of the support roller, and wherein the second position of the support roller is associated with an actuated position of the support roller.

7. The dispensing system of claim 1, wherein the dispensing mechanism comprises a main guide and a guide extension, the guide extension being a separate component from the main guide and being positioned circumferentially between the support roller and the main guide.

8. The dispensing system of claim 1, further comprising a dispense roller that is positioned at or near an outlet of the dispenser system and is configured to move from a first position to a second position in response to a user pulling on the tail end of the tissue, wherein the dispense roller is biased towards the first position and applies a compressive force to the main roller when in the second position.

9. The dispensing system of claim 1, wherein the system is configured such that:

when the tissue is pulled from the dispensing system, tension in the tissue increases; and the increase in the tension of the tissue causes the support roller to move from the first position to the second position against the force of gravity.

10. The dispensing system of claim 1, wherein the system is configured such that:

when at least a portion of the tissue is dispensed from the dispensing system, tension in the tissue decreases; and the decrease in the tension of the tissue causes the support roller to automatically move from the second position to the first position by force of gravity.

11. The dispensing system of claim 10, wherein:

the rotation system comprises a clip and a plurality of biasing members;

the clip is coupled to the axle of the main roller and the plurality of biasing members is fixedly coupled to the clip; and the plurality of biasing members generate restoring force to the main roller via the clip, the restoring force causing the main roller to rotate back to its resting position.

12. The dispensing system of claim 1, wherein the system is configured such that:

the main roller rotates in a first direction in response to the tissue pulled from the dispensing system, and the main roller rotates in a second direction after at least a portion of the tissue is dispensed.

13. The dispensing system of claim 1, wherein the dispensing system comprises a rotation system that facilitates rotation of the main roller after at least a portion of the tissue is dispensed from the dispensing system.

14. The dispensing system of claim 1, wherein:

the main roller has a first external surface and the support roller has a second external surface, wherein at least one of the first external surface and the second external surface comprises elastomeric portions.

15. The dispensing system of claim 1, wherein the support roller is biased toward the first position by gravity.

16. A dispensing mechanism for facilitating dispensing of tissue from a roll, the dispensing mechanism comprising:

a main roller;

a support roller having a first configuration and a second configuration, the support roller configured to move from the first configuration to the second configuration in response to the tissue being pulled from the dispensing system, the support roller biased towards the first configuration and adapted to apply a compressive force to the main roller when in the second configuration;

a main guide extending in an axial direction relative to the main roller and comprising a first guide wall, the first guide wall extending in a circumferential direction relative to an outer circumferential surface of the main roller; and a secondary guide extending in the axial direction relative to the main roller and positioned circumferentially between the support roller and the main guide, the secondary guide comprising a second guide wall extending in the circumferential direction relative to the outer circumferential surface of the main roller, the secondary guide fixed relative to the main guide;

wherein the main guide and the secondary guide are configured to cooperate to guide the tissue around more than 180 degrees of the outer circumferential surface of the main roller.

17. A method of manufacturing a dispensing system, the method comprising:

obtaining a support frame, a main roller, a support roller having a radial center, a guide, and a guide extension, wherein the guide comprises a first guide wall and the guide extension comprises a second guide wall, the first guide wall and the second guide wall having curvatures corresponding to a curve of an outer circumferential surface of the main roller;

positioning the guide extension circumferentially between the support roller and the guide; and positioning the support roller in an elongated slot of the support frame, the support roller configured to slide in the slot between a first configuration and a second configuration, wherein the radial center of the support roller is closer to the outer circumferential surface of the main roller in the second configuration than in the first configuration.

18. The method of claim 17, further comprising separately forming the guide and the guide extension.

19. The method of claim 17, further comprising fixedly connecting the guide extension and the guide.

* * * * *